US009055359B2

(12) United States Patent
Kamimura et al.

(10) Patent No.: US 9,055,359 B2
(45) Date of Patent: Jun. 9, 2015

(54) ELECTROACOUSTIC TRANSDUCING DEVICE

(75) Inventors: Tomohiko Kamimura, Osaka (JP); Hideo Yuasa, Shandong (CN); Jinlong Ren, Shandong (CN); Hidenori Motonaga, Shandong (CN); Katsunari Fujita, Shandong (CN)

(73) Assignee: HOSIDEN CORPORATION, Yao-Shi (JP)

( * ) Notice: Subject to any disclaimer, the term of this patent is extended or adjusted under 35 U.S.C. 154(b) by 1008 days.

(21) Appl. No.: 12/450,981

(22) PCT Filed: Feb. 9, 2009

(86) PCT No.: PCT/JP2009/052151
§ 371 (c)(1),
(2), (4) Date: Oct. 21, 2009

(87) PCT Pub. No.: WO2009/139202
PCT Pub. Date: Nov. 19, 2009

(65) Prior Publication Data

US 2011/0123061 A1 May 26, 2011

(30) Foreign Application Priority Data

May 13, 2008 (JP) ..... 2008-125471

(51) Int. Cl.
*H04R 9/02* (2006.01)
*H04R 31/00* (2006.01)
*H04R 9/06* (2006.01)

(52) U.S. Cl.
CPC *H04R 9/025* (2013.01); *H04R 9/06* (2013.01); *H04R 31/00* (2013.01); *H04R 2209/024* (2013.01); *H04R 2400/11* (2013.01)

(58) Field of Classification Search
CPC ..... H04R 2499/11; H04R 9/025; H04R 2400/11; H04R 2209/024; H04R 2209/027
USPC ..... 381/312, 396, 398, 412, 189, 399, 423, 381/426, 433, 150, 355, 356, 357, 358, 360, 381/361, 369; 29/594, 609.1
See application file for complete search history.

(56) References Cited

U.S. PATENT DOCUMENTS 4,520,237 A * 5/1985 Murakami ..... 381/412
5,581,623 A * 12/1996 Ishimura et al. ..... 381/396

(Continued)

FOREIGN PATENT DOCUMENTS

JP 57-138496 8/1982
JP 05336593 A 12/1993

(Continued)

OTHER PUBLICATIONS

European Search Report, EPO, Munich, Jan. 8, 2013 for the corresponding European Patent Application 097464093.3.

*Primary Examiner* — Davetta W Goins
*Assistant Examiner* — Jasmine Pritchard
(74) *Attorney, Agent, or Firm* — Rankin, Hill & Clark LLP

(57) ABSTRACT

An electroacoustic transducing device such as a small speaker or receiver used in a portable telephone or the like. A yoke-integral frame is formed by a simple process, and the number of components and production steps for producing the electroacoustic transducing device are reduced, thereby improving productivity. The transducing device having: a magnetic circuit having a yoke, a magnet, and a pole piece; a vibration system having a diaphragm and a voice coil; and a frame which holds the magnetic circuit and the vibration system. The voice coil is placed in a magnetic gap, and the frame is formed by performing a pressing process on one sheet-like metal material into a bottomed tubular shape, and at least two places of the bottom plate being cut and raised to form a bottom frame-like yoke portion, thereby being formed into a yoke-integral type.

8 Claims, 32 Drawing Sheets

(56) References Cited

U.S. PATENT DOCUMENTS

| | | | | |
|---|---|---|---|---|
| 6,807,282 | B2 * | 10/2004 | Kaneda et al. | 381/396 |
| 7,200,241 | B2 * | 4/2007 | Fukuyama et al. | 381/407 |
| 7,266,213 | B2 * | 9/2007 | Furuya | 381/398 |
| 7,965,856 | B2 * | 6/2011 | Sato et al. | 381/396 |
| 8,009,855 | B2 * | 8/2011 | Chiba | 381/396 |
| 2005/0271226 | A1 * | 12/2005 | Tanabu et al. | 381/182 |
| 2006/0098838 | A1 * | 5/2006 | Yoo | 381/398 |
| 2007/0053547 | A1 | 3/2007 | Ando | |
| 2008/0063234 | A1 | 3/2008 | Watanabe | |
| 2011/0075880 | A1 * | 3/2011 | Kamimura et al. | 381/413 |
| 2012/0237076 | A1 * | 9/2012 | Kuze | 381/387 |

FOREIGN PATENT DOCUMENTS

| | | |
|---|---|---|
| JP | 2004-128822 | 4/2004 |
| JP | 2004-356834 | 12/2004 |
| JP | 2007306468 A | 11/2007 |

* cited by examiner

ELECTROACOUSTIC TRANSDUCING DEVICE

TECHNICAL FIELD

The present invention relates to an electroacoustic transducing device such as a small and thin speaker or receiver to be used in a portable telephone or the like.

BACKGROUND ART

In order to improve the productivities of a yoke and a speaker, a rectangular speaker 101 which is as shown in FIG. 35, and which is assembled by using a yoke 100 such as shown in FIG. 34 is known (see Patent Literature 1).

The yoke 100 shown in FIG. 34 is formed into a bottomed rectangular frame-like shape by bending one sheet-like metal material which is previously punched, to dispose four bent and raised portions 100A.

In the speaker 101 shown in FIG. 35, a rectangular magnet 102 is clamped by the yoke 100 and an upper plate 103 having a rectangular plate-like shape, to constitute a magnetic circuit 104. The yoke 100 of the magnetic circuit 104 is pressingly inserted into a frame 105, and coupled thereto by interposing an adhesive agent between them. A diaphragm 106 is bonded to a peripheral edge portion of the frame 105, a voice coil 107 for driving the diaphragm is coupled to the diaphragm 106, and the voice coil 107 is fittingly coupled into a magnetic gap 108, thereby completing the speaker.

Patent Literature 1: Japanese Patent Application Laying-Open No. 2003-37892

DISCLOSURE OF THE INVENTION

Problems to be Solved by the Invention

In the above-described speaker, the productivity in the viewpoints of the number of components and that of production steps is not considered. Namely, the yoke is separated from the frame in order to enable the yoke to be formed by bending one sheet-like metal material. As compared with a speaker which is assembled by using a yoke-integral frame, therefore, the number of components and that of production steps are large, and hence the productivity is poor.

On the other hand, a yoke-integral frame is produced by cold forging. Therefore, the process step number is large, and the productivity is not high, so that a yoke-integral frame is an expensive component.

It is an object of the invention to form a yoke-integral frame by a simple pressing process, and reduce the numbers of components and production steps of an electroacoustic transducing device, thereby improving the productivity.

Means for Solving the Problems

In order to attain the object, the invention set forth in claim 1 provides an electroacoustic transducing device comprising: a magnetic circuit having a yoke, a magnet, and a pole piece; a vibration system having a diaphragm and a voice coil; and a frame which holds the magnetic circuit and the vibration system, the voice coil being placed in a magnetic gap, wherein the frame is formed by performing a drawing process on one sheet-like metal material into a bottomed tubular shape, at least two openings are disposed in a bottom plate, and a bottomed frame-like yoke portion is disposed inside by a pressing process, thereby being formed into a yoke-integral type.

Therefore, a yoke-integral frame can be formed by a simple pressing process.

In order to attain the object, the invention set forth in claim 2 provides an electroacoustic transducing device comprising: a magnetic circuit having a yoke, a magnet, and a pole piece; a vibration system having a diaphragm and a voice coil; and a frame which holds the magnetic circuit and the vibration system, the voice coil being placed in a magnetic gap, wherein the frame is formed by performing a drawing process on one sheet-like metal material into a bottomed tubular shape, and at least two places of a bottom plate of the frame are cut and raised to form a bottomed frame-like yoke portion, thereby being formed into a yoke-integral type.

Therefore, a yoke-integral frame can be formed by a simple pressing process.

In order to attain the object, the invention set forth in claim 3 provides an electroacoustic transducing device comprising: a magnetic circuit having a yoke, a magnet, and a pole piece; a vibration system having a diaphragm and a voice coil; and a frame which holds the magnetic circuit and the vibration system, the voice coil being placed in a magnetic gap, wherein the frame is formed by performing a drawing process on one sheet-like metal material into a bottomed tubular shape, at least two openings are disposed in a bottom plate, and a bottomed frame-like yoke portion is disposed inside by a drawing process, thereby being formed into a yoke-integral type.

Therefore, a yoke-integral frame can be formed by a simple pressing process.

Effects of the Invention

According to the invention set forth in claim 1, in the electroacoustic transducing device comprising: the magnetic circuit having the yoke, the magnet, and the pole piece; the vibration system having the diaphragm and the voice coil; and the frame which holds the magnetic circuit and the vibration system, the voice coil being placed in the magnetic gap, the frame is formed by performing a drawing process on one sheet-like metal material into a bottomed tubular shape, at least two openings are disposed in a bottom plate, and a bottomed frame-like yoke portion is disposed inside by a pressing process, thereby being formed into a yoke-integral type. Therefore, a yoke-integral frame can be formed by a simple pressing process, the numbers of components and production steps of the electroacoustic transducing device can be reduced, and the productivity can be improved.

According to the invention set forth in claim 2, in the electroacoustic transducing device comprising: the magnetic circuit having the yoke, the magnet, and the pole piece; the vibration system having the diaphragm and the voice coil; and the frame which holds the magnetic circuit and the vibration system, the voice coil being placed in the magnetic gap, the frame is formed by performing a drawing process on one sheet-like metal material into a bottomed tubular shape, and at least two places of the bottom plate of the frame are cut and raised to form a bottomed frame-like yoke portion, thereby being formed into a yoke-integral type. Therefore, a yoke-integral frame can be formed by a simple pressing process, the numbers of components and production steps of the electroacoustic transducing device can be reduced, and the productivity can be improved.

According to the invention set forth in claim 3, in the electroacoustic transducing device comprising: the magnetic circuit having the yoke, the magnet, and the pole piece; the vibration system having the diaphragm and the voice coil; and the frame which holds the magnetic circuit and the vibration system, the voice coil being placed in the magnetic gap, the frame is formed by performing a drawing process on one sheet-like metal material into a bottomed tubular shape, at least two openings are disposed in the bottom plate, and the bottomed frame-like yoke portion is disposed inside by a drawing process, thereby being formed into a yoke-integral type. Therefore, a yoke-integral frame can be formed by a simple pressing process, the numbers of components and production steps of the electroacoustic transducing device can be reduced, and the productivity can be improved.

DESCRIPTION OF REFERENCE NUMERALS

1 frame, 2 bottom plate, 4 yoke portion, 7 first opening, 8 second opening, 9 third opening, 10 speaker, magnet, 12 pole piece, 13 magnetic circuit, 14 diaphragm, 15 voice coil, 16 vibration system, 17 external connection terminal, 19, 20 lead wire, 21 magnetic gap, 41 frame, 42 bottom plate, 44 yoke portion, 47 first opening, 48 second opening, 49 third opening, 50 speaker, 51 magnet, 52 pole piece, 53 magnetic circuit, 54 diaphragm, 55 voice coil, 56 vibration system, 59, 60 lead wire, 61 magnetic gap, 201 frame, 204 yoke portion, 208 frame portion, 211 first opening, 212 second opening, 213 third opening, 213*a* cutout, 214 fourth opening, 215 raised portion, 216 speaker body, 217 magnet, 218 pole piece, 219 magnetic circuit, 219*a* magnetic gap, 220 diaphragm, 221 voice coil, 221*a* lead wire, 222 vibration system, 223 printed wiring board, 223*a* surface land, 225, 229 speaker, 301 frame, 304 yoke portion, 308 frame portion, 309 first opening, 310 second opening, 310*a* cutout, 311 speaker body, 312 magnet, 313 pole piece, 314 magnetic circuit, 314*a* magnetic gap, 315 printed wiring board, 318 diaphragm, 319 voice coil, 319*a* lead wire, 320 voice coil/bobbin/damper, 321 vibration system, 325 speaker

BEST MODE FOR CARRYING OUT THE INVENTION

Hereinafter, Embodiments 1 and 2 of the invention will be described with reference to the drawings.

Embodiment 1

Figure 1:
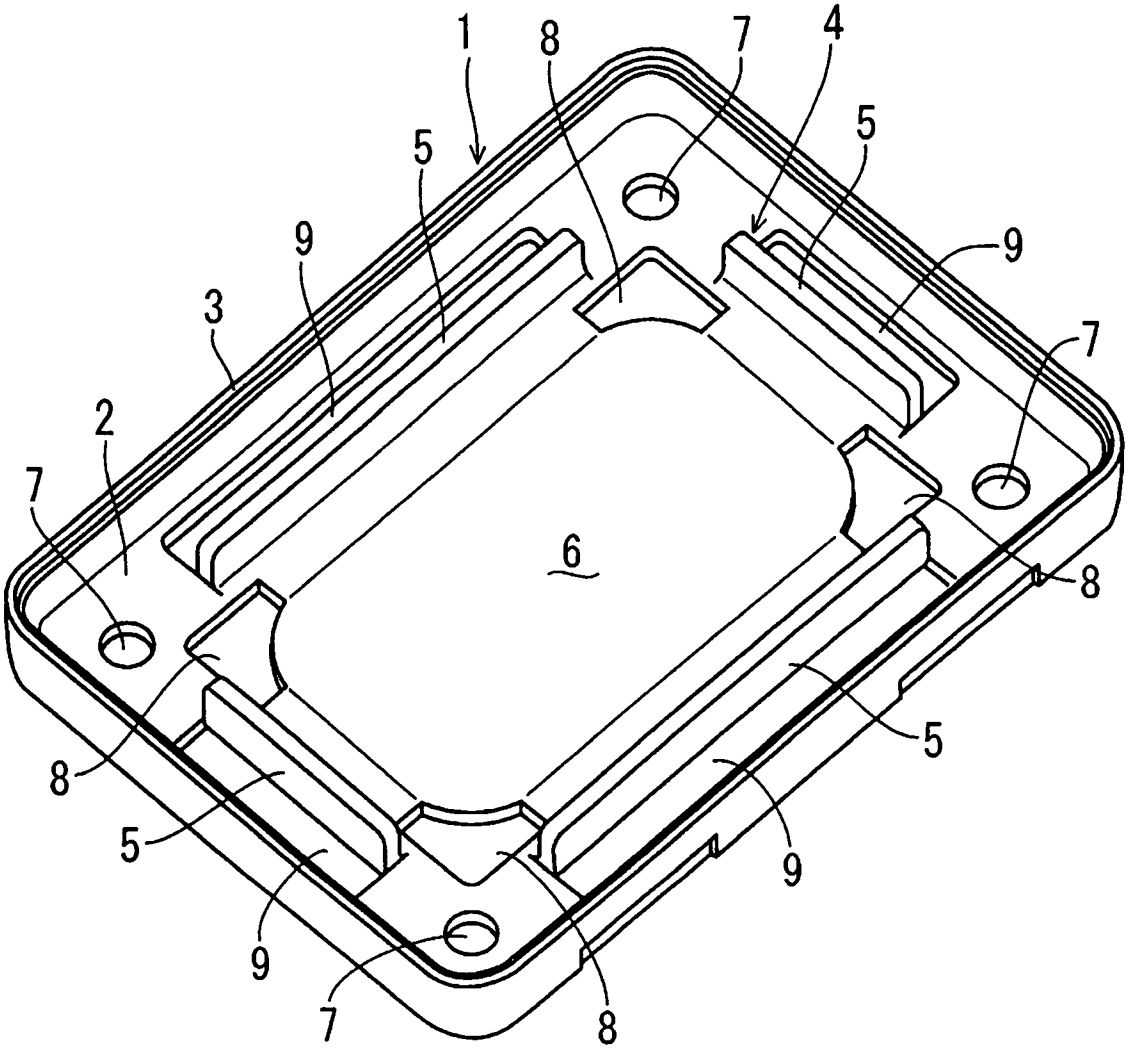
FIG. 1 is a perspective view of a frame in Embodiment 1 of the invention.

Embodiment 1 will be described with reference to FIGS. 1 to 8. FIG. 1 is a perspective view of a rectangular frame in an embodiment of the invention.

The frame 1 shown in FIG. 1 is formed into a shallow bottomed rectangular tubular shape which is configured by applying a pressing process (a drawing process) on one sheet-like metal material to dispose a rectangular bottom plate 2 and a sidewall 3 that is perpendicularly raised from the outer edge of the plate. Cutting and bending processes are performed on the bottom plate 2 to raise four outer side portions of the bottom plate 2, whereby a rectangular bottomed frame-like yoke portion 4 which is slightly smaller than the sidewall 3 is formed inside the sidewall 3, whereby the frame is formed as a yoke-integral type.

The yoke portion 4 is configured by: four yoke sidewalls 5 which are opposed to the inside of the sidewall 3 across a predetermined space; and a rectangular yoke bottom plate 6 which is configured by a middle. portion of the bottom plate 2 that is inside the yoke sidewalls 5.

First openings 7 which are formed in four corner portions of the bottom plate 2, respectively, and which are circular, second openings 8 which are formed in four corner portions of the yoke bottom plate 6, respectively, and which have a substantially L-like shape are disposed in the frame 1, and third openings 9 which are formed by cutting and raising of the yoke sidewalls 5 from the bottom plate 2, and which have an elongated rectangular shape are disposed in four places of an outer side portion of the bottom plate 2, respectively are disposed in the frame 1.

Figure 2:
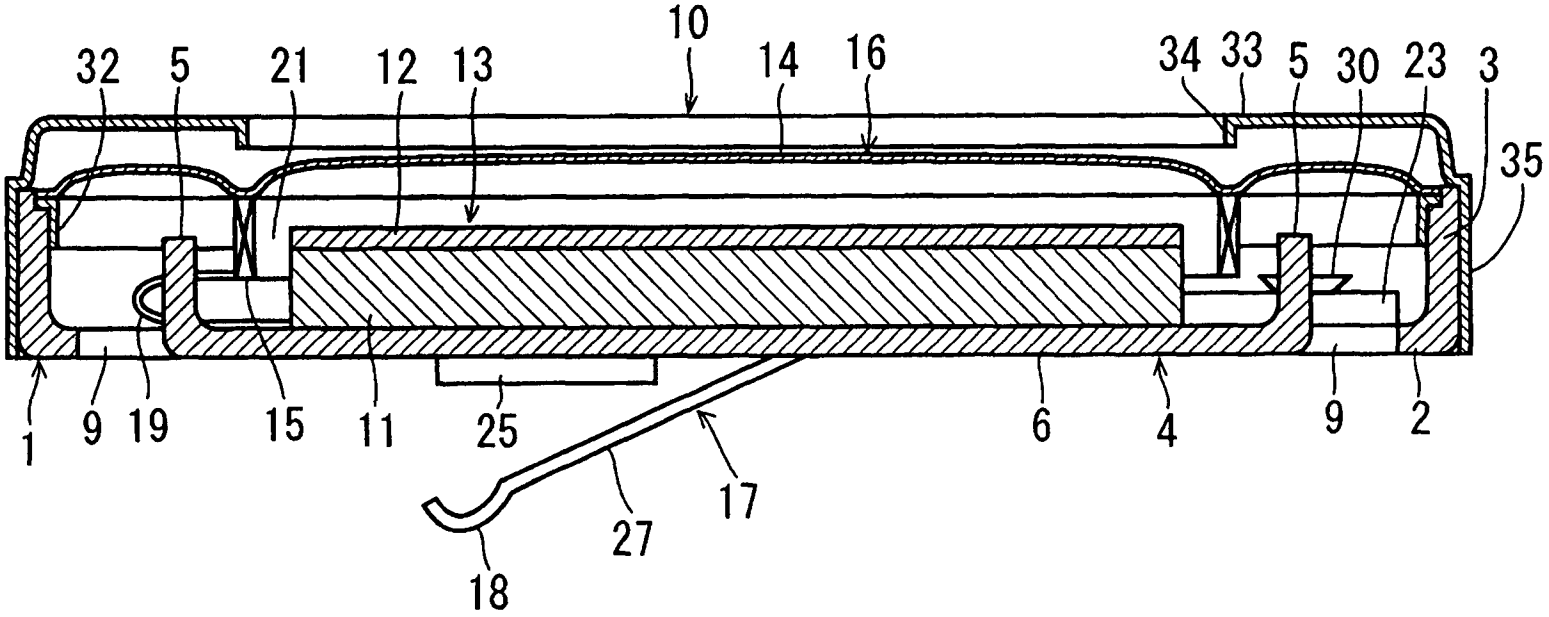
FIG. 2 is a mid-sectional view of a speaker (an example of the electroacoustic transducing device) in Embodiment 1 of the invention.
Figure 3:
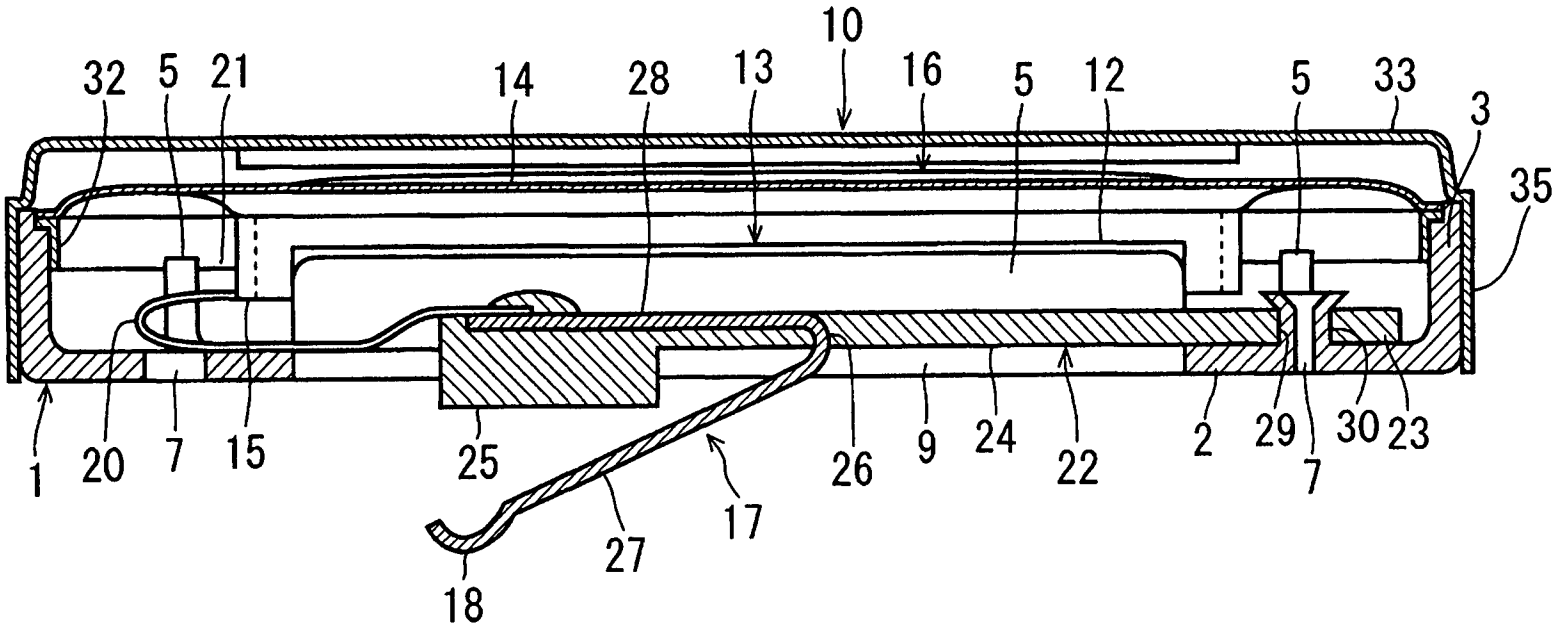
FIG. 3 is a longitudinal sectional view of a terminal portion of the speaker (an example of the electroacoustic transducing device) in Embodiment 1 of the invention.
Figure 4:
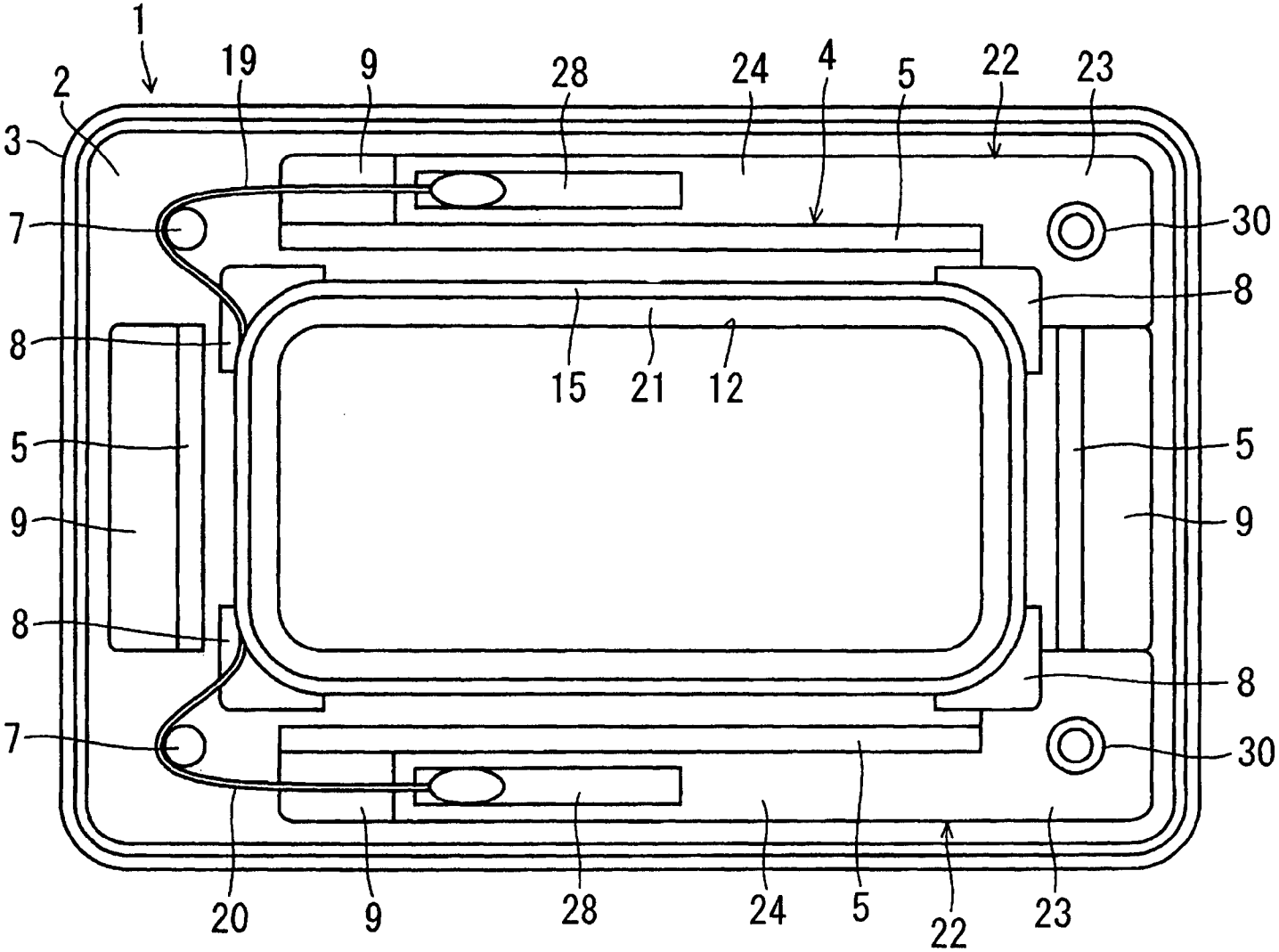
FIG. 4 is a plan view of a state where a baffle, a diaphragm, and a diaphragm ring in the speaker (an example of the electroacoustic transducing device) in Embodiment 1 of the invention are made transparent.

FIG. 2 is a mid-sectional view of a rectangular speaker (an example of the electroacoustic transducing device) which is assembled by using the rectangular frame shown in FIG. 1, FIG. 3 is a longitudinal sectional view of a terminal portion of the speaker, and FIG. 4 is a plan view of a state where a baffle, the diaphragm, and a diaphragm ring of the speaker are made transparent.

In the speaker 10 shown in FIGS. 2 to 4, a magnet 11 which is a rectangular columnar permanent magnet is bonded and fixed onto the yoke bottom plate 6, a pole piece 12 which is configured by a rectangular metal plate is bonded and fixed onto the magnet 11, and the yoke portion 4, the magnet 11, and the pole piece 12 constitute a magnetic circuit 13.

On the other hand, a rectangular diaphragm 14 which is configured by a resin or metal film, and a rectangular tubular voice coil 15 are concentrically bonded and fixed to each other, and the diaphragm 14 and the voice coil 15 constitute a vibration system 16.

A pair of external connection terminals 17 are attached to the frame 1, and contact portions 18 of the external connection terminals 17 are projected to the outside from the bottom face of the frame 1.

Two lead wires 19, 20 drawn out from the voice coil 15 are connected to the external connection terminals 17 by soldering, respectively, an outer peripheral edge portion of the diaphragm 14 is bonded and fixed to the sidewall 3, the voice coil 15 is inserted into a magnetic gap 21 which is below the diaphragm 14, and the magnetic circuit 13 and the vibration system 16 are held by the frame 1, thereby completing the speaker.

The thus configured speaker 10 is used in, for example, a portable telephone. When an electric audio signal is supplied from an external circuit to the voice coil 15 through the pair of external connection terminals 17, the interaction between the magnetic field generated in the magnetic circuit 13 and that generated as a result of the energization of the voice coil 15 causes the voice coil 15 to vertically vibrate, and, in accordance with this, the diaphragm 14 vertically vibrates to generate a sound.

According to the above-described configuration, the frame 1 is formed by performing a pressing process on one sheet-like metal material into a bottomed rectangular tubular shape, and four places of the bottom plate 2 of the frame 1 are cut and raised to form the rectangular bottomed frame-like yoke portion 4, thereby being formed into a yoke-integral type. Therefore, the yoke-integral frame can be formed not by cold forging as in the conventional art, but by a simple pressing process, the numbers of components and production steps of the speaker 10 can be reduced, and the productivity can be improved.

Furthermore, the frame 1 is formed by one sheet-like metal material. As compared with a conventional resin-made frame which is separated from a yoke, necessary strength can be easily ensured while the thickness is suppressed, and hence the speaker 10 can be further miniaturized and thinned.

Moreover, the third openings 9 which are disposed on the bottom plate 2 by cutting and raising of the yoke sidewalls 5 from the bottom plate 2 can be used as rear sound holes for the speaker 10, and drawn-out openings for drawing out the external connection terminals 17 to the outside. Therefore, steps of processing them can be omitted.

Moreover, the internal structure can be changed without changing the external shape of the speaker 10. Namely, the place, number, shape, and size of the cut and raised portions of the yoke sidewalls 5 from the bottom plate 2 can be changed without being affected by the external shape of the frame 1, and hence the magnetic circuit 13 having a different performance (the shape, the size, and the like) can be configured, or rear sound holes (the third openings 9) having a different performance (the size) can be disposed. Therefore, the acoustic performance of the speaker 10 can be optimized.

In the embodiment, as shown in FIGS. 2 to 4, among the four third openings 9, the two third openings 9 which are in right and left outside portions of the bottom plate 2 (the upper and lower side portions of the sheet of FIG. 4) are used as sound holes, and the two third openings 9 which are in front and rear outside portions of the bottom plate 2 (the right and left side portions of the sheet of FIG. 4) are used as the drawn-out openings for the external connection terminals 17.

Each of the external connection terminals 17 is formed by applying punching and bending processes on a thin metal plate, and integrated with a resin-made insulating member 22 by insert molding.

In the insulating member 22, an attaching portion 23 which is overlapped on and fixed to a corner portion of the bottom plate 2, an extending portion 24 which is extended from the attaching portion 23 onto the third opening that is the drawn-out opening for the external connection terminal 17, and a fitting portion 25 which is projected from the extending portion 24 to be fitted into the third opening 9 that is on the lower side are integrally formed.

In each of the external connection terminals 17, a fixing portion 26 which is embedded in a resin of the extending portion 24, a cantilever-like spring piece 27 which is extended from the fixing portion 26 to be inclinedly projected from the bottom face of the frame 1 to the outside through the lower third opening 9, and in which a contact portion 18 is formed in a projected end portion so that the lower face is convex and the upper face is concave, and a solder pad portion 28 which is embedded in the resin of the extending portion 24 so that one surface is exposed substantially flushly with the upper face of the extending portion 24, and which is conductingly connected to the fixing portion 26 are integrally formed.

The lead wires 19, 20 are drawn out from the voice coil 15 to the left side (the lower side of the sheet of FIG. 4), and then drawn out to the outsides of the both longitudinal yoke sidewalls 5 which are cut and raised from the front and rear outside portions of the bottom plate 2 (the right and left side portions of the sheet of FIG. 4), through a gap between one short-side yoke sidewall 5 which is cut and raised from the left outside portion (the lower side of the sheet of FIG. 4) of the bottom plate 2, and the both longitudinal yoke sidewalls 5. In the external connection terminals 17, the attaching portions 23 are fixed to corner portions of the right side (the upper side of the sheet of FIG. 4) of the bottom plate 2 which is opposite to the drawn out side of the lead wires 19, 20, the spring pieces 27 are projected to the outside from the bottom face of the frame 1 through the third openings 9 which are in the front and rear outside portions of the bottom plate 2, the solder pad portions 28 are exposed and placed on bottom portions outside the both longitudinal yoke sidewalls 5 in the frame 1, and the lead wires 19, 20 are connected to the solder pad portions 28 by soldering.

Each of the external connection terminals 17 is fixed to the frame 1 by: previously forming a through hole 29 extending between the upper and lower faces in the attaching portion 23; forming a cylindrical raised portion 30 by a burring process around the first opening 7 in the corner portion of the bottom plate 2 on which the attaching portion 23 is to be overlaid; when the attaching portion 23 is to be overlaid on the corner portion of the bottom plate 2, passing the raised portion 30 through the through hole 29 from the lower face side of the attaching portion 23 to the upper face side; and applying a crushing process on an end portion of the raised portion 30 which is projected from the upper face of the attaching portion 23.

Figure 5:
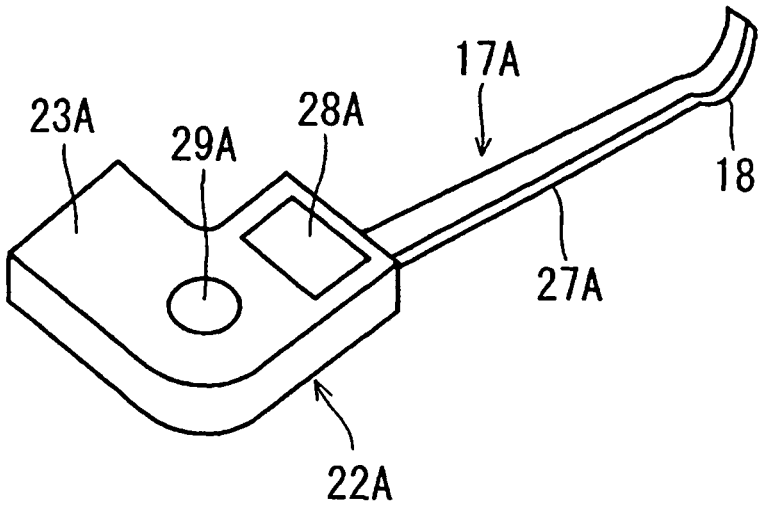
FIG. 5 is a perspective view of another external connection terminal of the speaker (an example of the electroacoustic transducing device) in Embodiment 1 of the invention.
Figure 6:
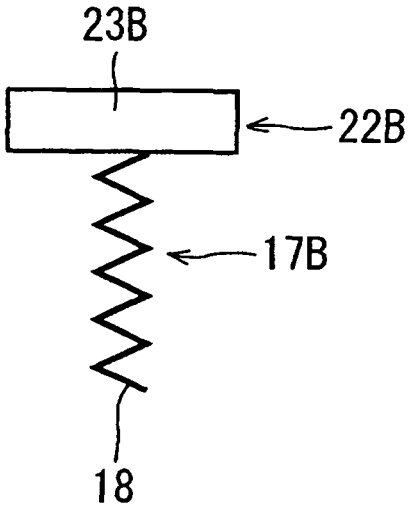
FIG. 6 is a perspective view of a further external connection terminal of the speaker (an example of the electroacoustic transducing device) in Embodiment 1 of the invention.

Other external connection terminals 17A or 17B such as shown in FIG. 5 or 6 may be used in place of the external connection terminals 17 shown in FIGS. 2 to 4.

Each of the other external connection terminals 17A shown in FIG. 5 is formed by applying punching and bending processes on a thin metal plate, and integrated with a resin-made insulating member 22A by insert molding.

In the insulating member 22A, an attaching portion 23A which has a through hole 29A extending between the upper and lower faces, and which is overlapped on and fixed to a corner portion of the bottom plate 2 is formed.

In each of the external connection terminals 17A, a fixing portion (not shown) which is embedded in a resin of the attaching portion 23A, a cantilever-like spring piece 27A which is extended from one side of the fixing portion to be inclinedly projected from the bottom face of the frame 1 to the outside through the third opening 9 that is in the extending direction, and in which a contact portion 18 is formed in a projected end portion so that the lower face is convex and the upper face is concave, and a solder pad portion 28A which is embedded in the attaching portion 23A so that one surface is exposed substantially flushly with the upper face of the attaching portion 23A, and which is conductingly connected to the fixing portion are integrally formed.

The thus configured external connection terminals 17A are paired. In the external connection terminals 17A, the attaching portions 23A are fixed to corner portions of the right side (the upper side of the sheet of FIG. 4) of the bottom plate 2, the spring pieces 27A are projected to the outside from the bottom face of the frame 1 through the third openings 9 which are in the front and rear outside portions of the bottom plate 2, the solder pad portions 28A are exposed and placed on bottom portions in the right corners in the frame 1, and the lead wires 19, 20 are connected to the solder pad portions 28A by soldering.

The external connection terminals 17A are fixed to the frame 1 in the same method as the external connection terminals 17 shown in FIGS. 2 to 4. In FIG. 5, among the pair of external connection terminals 17A, only the one external connection terminal 17A corresponding to the external connection terminal 17 which is in the left side of the sheet of FIG. 4 is shown, and illustration of the other external connection terminal 17A corresponding to the external connection terminal 17 which is in the right side of the sheet of FIG. 4 is omitted. The other external connection terminal has the same structure as the one external connection terminal 17A except that the external shapes of the attaching portions 23A are symmetrical to each other in the same manner the external connection terminals 17 shown in FIG. 4.

Each of the other external connection terminals 17B shown in FIG. 6 is configured by a coil spring, and integrated with a resin-made insulating member 22B by insert molding.

In the insulating member 22B, an attaching portion 23B which is overlapped on and fixed to a corner portion of the bottom plate 2 is formed.

In each of the external connection terminals 17B which are coil spring, an upper portion is embedded in a resin of the attaching portion 23B and projected toward the lower face of the attaching portion 23B, and a projected end portion of the external connection terminal 17B is configured as the contact portion 18. A solder pad portion (not shown) which is embedded in the attaching portion 23B so that one surface is exposed substantially flushly with the upper face of the attaching portion 23B is conductingly connected to the external connection terminal 17B.

The thus configured external connection terminals 17B are paired. In the external connection terminals 17B, the attaching portions 23B are fixed to corner portions of the right side (the upper side of the sheet of FIG. 4) of the bottom plate 2, projected to the outside from the bottom face of the frame 1 through the first openings 7 which are below the attaching portions 23B, the solder pad portions are exposed and placed on bottom portions in the right corners in the frame 1, and the lead wires 19, 20 are connected to the solder pad portions by soldering.

The external connection terminals 17B can be fixed to the frame 1 in the same method as the external connection terminals 17 and 17A. Alternatively, an adhesive agent may be used. In FIG. 6, among the pair of external connection terminals 17B, only the external connection terminal 17B corresponding to one of the paired external connection terminals 17 which are shown in FIGS. 2 to 4 is shown, and illustration of the external connection terminal 17B corresponding to the other external connection terminal 17 is omitted. The other external connection terminal has the same structure as the one external connection terminal 17B.

Figure 7:
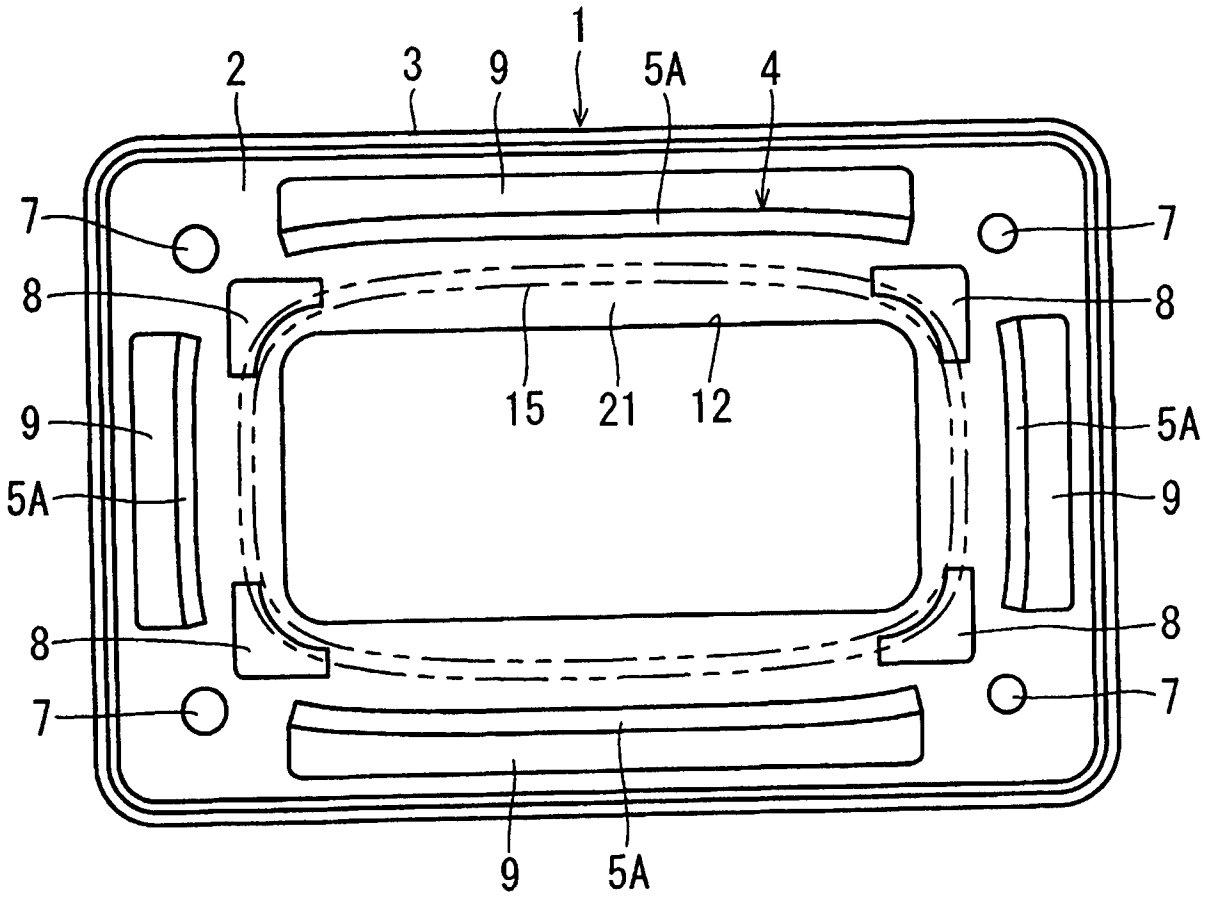
FIG. 7 is a plan view showing a modification of the frame of the speaker (an example of the electroacoustic transducing device) in Embodiment 1 of the invention.

In the embodiment, the rectangular tubular voice coil 15 is used. In the rectangular tubular voice coil 15, as shown in FIG. 7, even when the coil is formed into a rectangular shape, the side portions are sometime curved and deformed by springback of the winding so that the outer face is convex and the inner face is concave. As a counter measure against the deformation of the rectangular voice coil 15, other yoke sidewalls 5A such as shown in FIG. 7 may be cut and raised from the bottom plate 2.

Namely, the other yoke sidewalls 5A shown in FIG. 7 are cut and raised from the bottom plate 2 in a curved state where the outer face is convex and the inner face is concave, thereby preventing the sidewalls from being contacted with the rectangular voice coil 15 even when the voice coil is deformed by springback of the winding.

Figure 8:
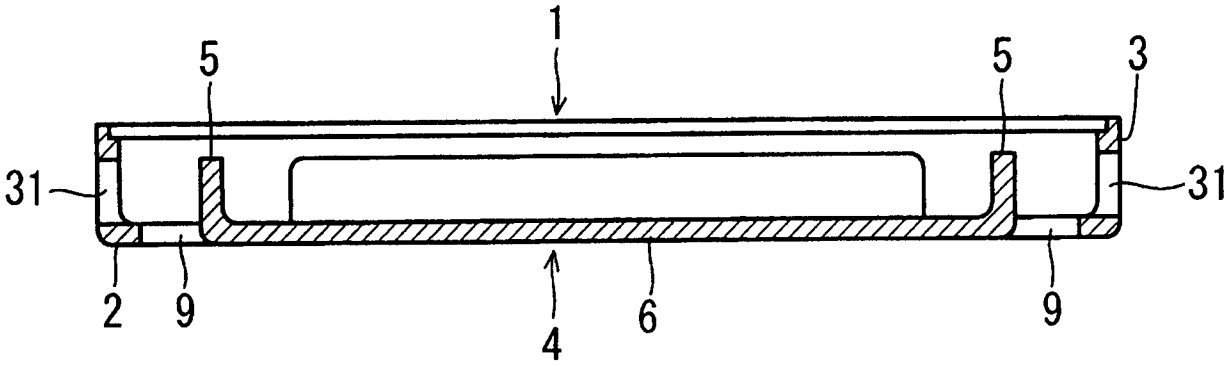
FIG. 8 is a plan view showing another modification of the frame of the speaker (an example of the electroacoustic transducing device) in Embodiment 1 of the invention.

In the embodiment, the third openings 9 which are disposed in the bottom plate 2 by cutting and raising of the yoke sidewalls 5 from the bottom plate 2 are used as the rear sound holes for the speaker 10. In the case where the rear sound holes (third openings 9) are closed as result of surface mounting or the like, rear sound holes 31 may be disposed in the sidewall 3 of the frame 1 as shown in FIG. 8. The rear sound holes 31 shown in FIG. 8 are disposed in the short side portions of the sidewall 3.

In the embodiment, as shown in FIGS. 2 and 3, a rectangular diaphragm ring 32 is bonded and fixed to the outer peripheral edge portion of the diaphragm 14, and the outer peripheral edge portion of the diaphragm 14 is bonded and fixed to the sidewall 3 through the diaphragm ring 32. A rectangular baffle 33 which covers an upper opening of the frame 1 is disposed. The baffle 33 is formed by performing a pressing process on a metal plate, and has a front sound hole 34 which is opposed to the diaphragm 14. A rectangular tubular edge portion 35 hangs from the outer peripheral edge portion of the baffle, and the edge portion 35 is fitted to the outside of the sidewall 33 to be coupled with the frame 1.

Embodiment 2

Figure 9:
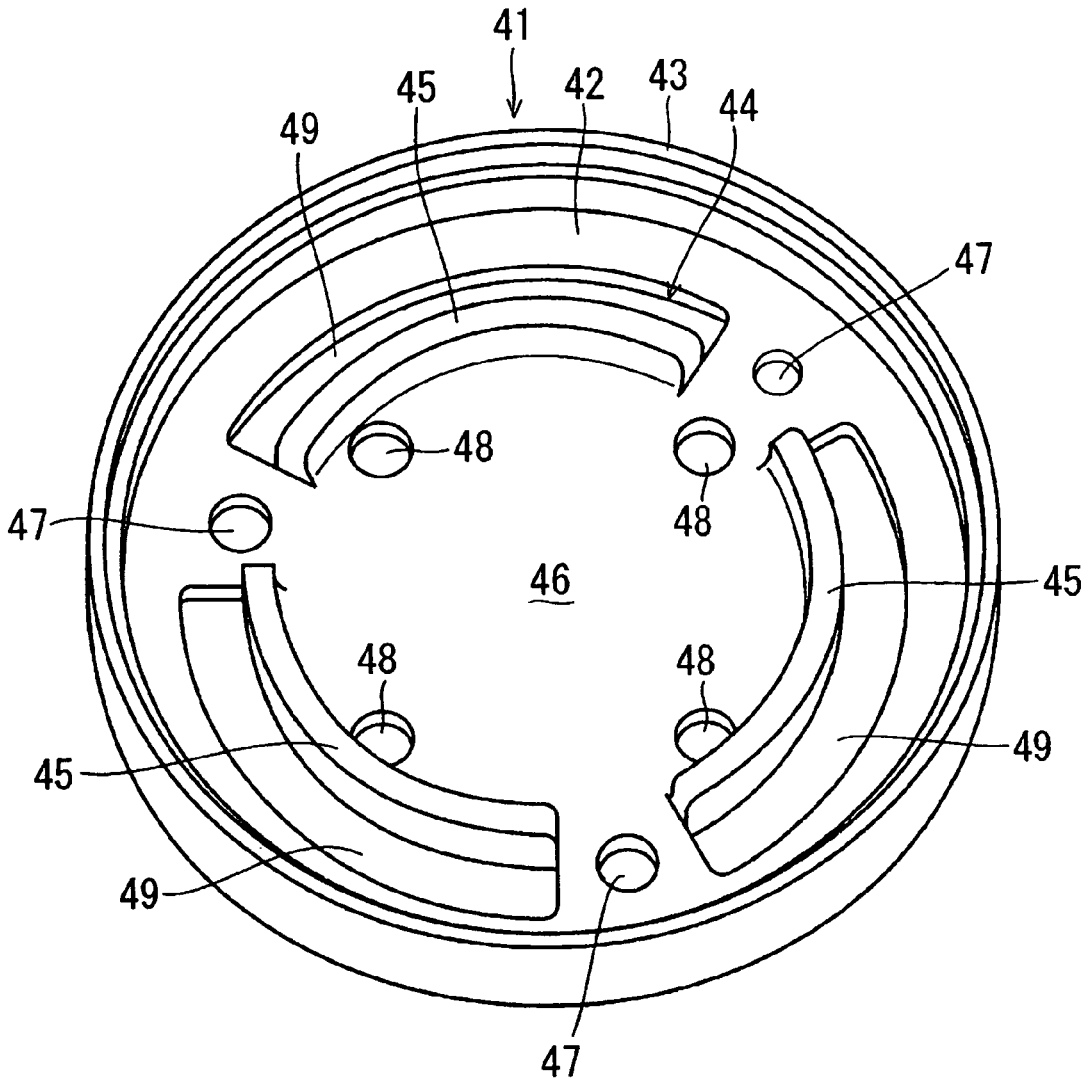
FIG. 9 is a perspective view of a frame in Embodiment 2 of the invention.

Embodiment 2 will be described with reference to FIGS. 9 to 11. FIG. 9 is a perspective view of a circular frame in an embodiment of the invention.

The frame 41 shown in FIG. 9 is formed into a shallow bottomed cylindrical shape which is configured by applying a pressing process (a drawing process) on one sheet-like metal material to dispose a circular bottom plate 42 and a sidewall 43 that is perpendicularly raised from the outer peripheral edge of the plate. Cutting and bending processes are performed on the bottom plate 42 to raise three outer side portions of the bottom plate 42, whereby a circular bottomed frame-like yoke portion 44 which is slightly smaller than the sidewall 43 is formed inside the sidewall 43. As a result, the frame is formed as a yoke-integral type.

The yoke portion 44 is configured by: three yoke sidewalls 45 which are opposed to the inside of the sidewall 43 across a predetermined space, and which are arcuately curved; and a circular yoke bottom plate 46 which is configured by a middle portion of the bottom plate 42 that is inside the yoke sidewalls 45.

Three first openings 47 which are formed between the yoke sidewalls 45 of the bottom plate 42, respectively, and which are circular, and four second openings 48 which are formed at substantially regular intervals in an outer side portion of the yoke bottom plate 46, respectively, and which are circular are disposed in the frame 41. Third openings 49 which are formed at substantially regular intervals by raising the yoke sidewalls 45 from the bottom plate 42, and which are thinly and arcuately curved are disposed in three places of an outer side portion of the bottom plate 42, respectively.

Figure 10:
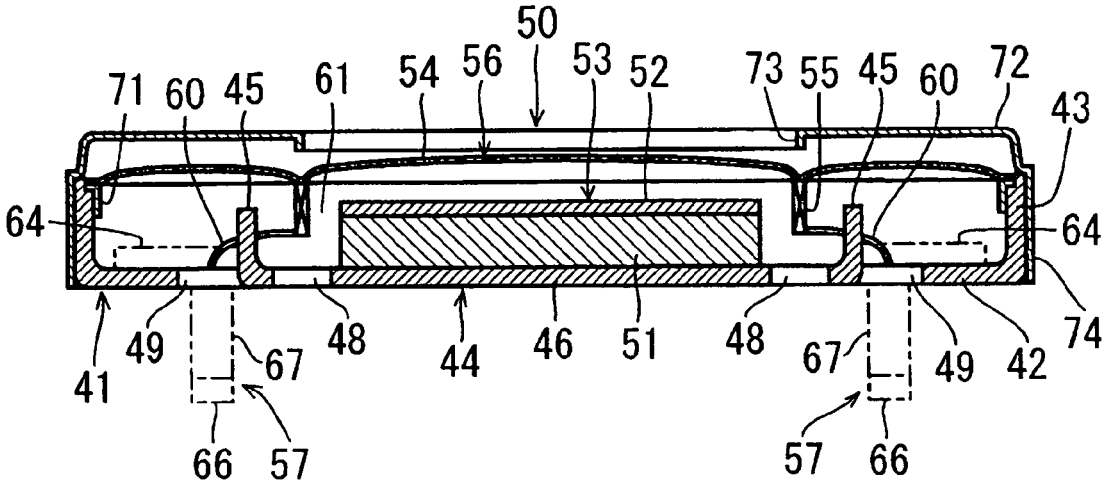
FIG. 10 is a mid-sectional view of a speaker (an example of the electroacoustic transducing device) in Embodiment 2 of the invention.
Figure 11:
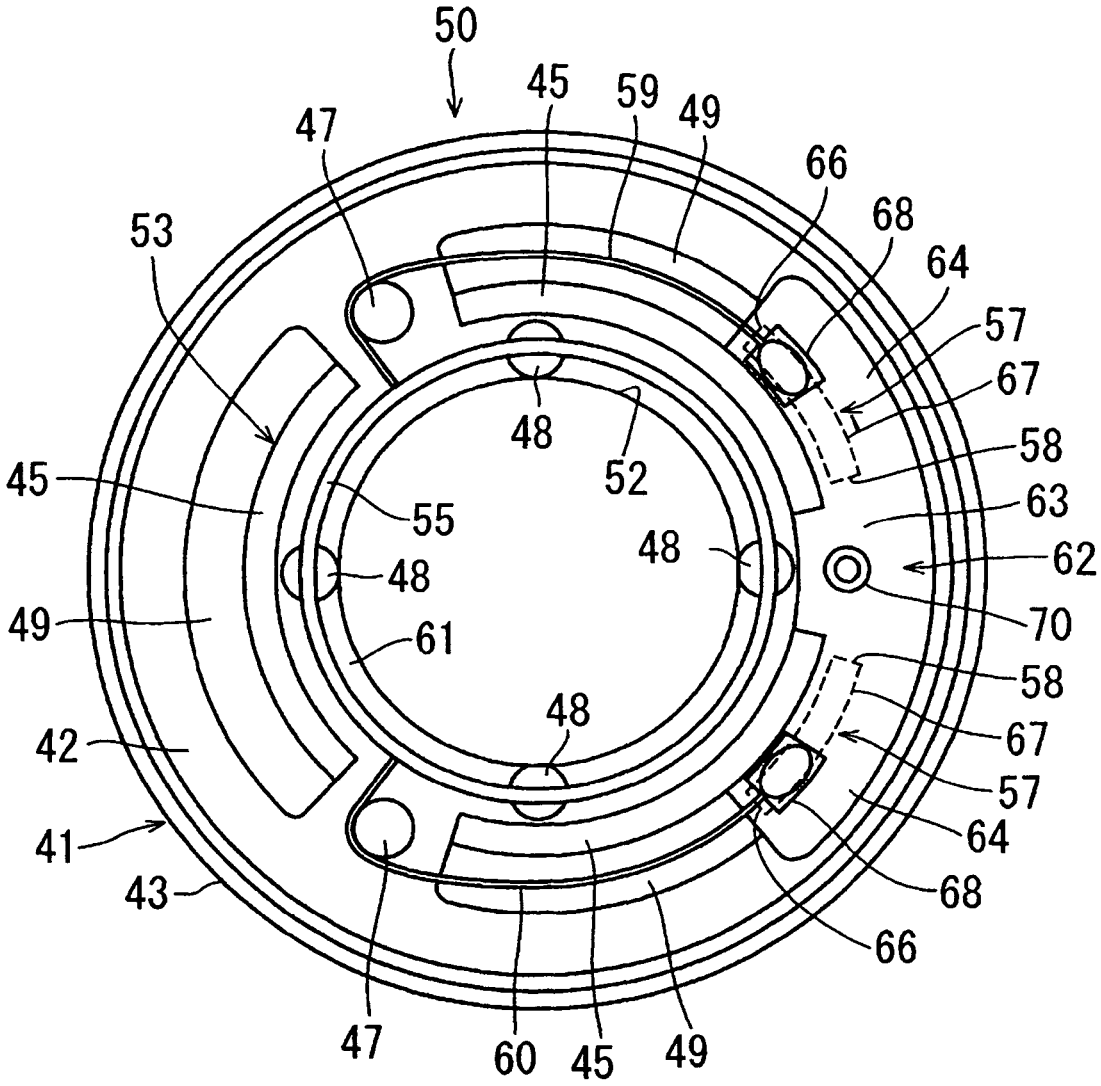
FIG. 11 is a plan view of a state where a baffle, a diaphragm, and a diaphragm ring in the speaker (an example of the electroacoustic transducing device) in Embodiment 2 of the invention are made transparent.

FIGS. 10 and 11 are mid-sectional views of a circular speaker (an example of the electroacoustic transducing device) which is assembled by using the circular frame shown in FIG. 9, and FIG. 11 is a plan view of a state where a baffle, the diaphragm, and the diaphragm ring are made transparent in the speaker.

In the speaker 50 shown in FIGS. 10 and 11, a magnet 51 which is a columnar permanent magnet is bonded and fixed onto the yoke bottom plate 46, a pole piece 52 which is configured by a circular metal plate is bonded and fixed onto the magnet 51, and the yoke portion 44, the magnet 51, and the pole piece 52 constitute a magnetic circuit 53.

On the other hand, a circular diaphragm 54 which is configured by a resin or metal film, and a cylindrical voice coil 55 are concentrically bonded and fixed to each other, and the diaphragm 54 and the voice coil 55 constitute a vibration system 56.

A pair of external connection terminals 57 are attached to the frame 41, and contact portions 58 of the external connection terminals 57 are projected from the bottom face of the frame 41 to the outside.

Two lead wires 59, 60 drawn out from the voice coil 55 are connected to the external connection terminals 57 by soldering, respectively, an outer peripheral edge portion of the diaphragm 54 is bonded and fixed to the sidewall 43, the voice coil 55 is inserted into a magnetic gap 61 which is below the diaphragm 54, and the magnetic circuit 53 and the vibration system 56 are held by the frame 41, thereby completing the speaker.

The thus configured speaker 50 is used in, for example, a portable telephone. When an electric audio signal is supplied from an external circuit to the voice coil 55 through the pair of external connection terminals 57, the interaction between the magnetic field generated in the magnetic circuit 53 and that generated as a result of the energization of the voice coil 55 causes the voice coil 55 to vertically vibrate, and, in accordance with this, the diaphragm 54 vertically vibrates to generate a sound.

According to the above-described configuration, the frame 41 is formed by performing a pressing process on one sheet-like metal material into a bottomed cylindrical shape, and three places of the bottom plate 42 of the frame 41 are cut and raised to form the circular bottomed frame-like yoke portion 44, thereby being formed into a yoke-integral type. Therefore, the yoke-integral frame can be formed not by cold forging as in the conventional art, but by a simple pressing process, the numbers of components and production steps of the speaker 50 can be reduced, and the productivity can be improved.

Furthermore, the frame 41 is formed by one sheet-like metal material. As compared with a conventional resin-made frame which is separated from a yoke, necessary strength can be easily ensured while the thickness is suppressed, and hence the speaker 50 can be further miniaturized and thinned.

Moreover, the third openings 49 which are disposed on the bottom plate 42 by cutting and raising of the yoke sidewalls 45 from the bottom plate 42 can be used as rear sound holes for the speaker 50, and drawn-out openings for drawing out the external connection terminals 57 to the outside. Therefore, steps of processing them can be omitted.

Moreover, the internal structure can be changed without changing the external shape of the speaker 50. Namely, the place, number, shape, and size of the cut and raised portions of the yoke sidewalls 45 from the bottom plate 42 can be changed without being affected by the external shape of the frame 41, and hence the magnetic circuit 53 having a different performance (the shape, the size, and the like) can be configured, or rear sound holes (the third openings 49) having a different performance (the size) can be disposed. Therefore, the acoustic performance of the speaker 50 can be optimized.

In the embodiment, as shown in FIG. 11, the three third openings 49 are used as rear sound holes and drawn-out openings for the external connection terminals 57.

The external connection terminals 57 are formed by applying punching and bending processes on a thin metal plate, and integrated with a single resin-made insulating member 62 by insert molding.

In the insulating member 62, an attaching portion 63 which is overlapped on and fixed to one of gaps between the yoke sidewalls 45 of the bottom plate 42, and an arcuate extending portion 64 which is extended from the both sides of the attaching portion 63, and which is on a substantially half of the two third openings 49 that are disposed on the bottom plate 42 by cutting and raising of the two yoke sidewalls 45 from the bottom plate 42 sandwiching the attaching portion 63 are integrally formed.

In each of the external connection terminals 57, a fixing portion 66 which is embedded in a resin of the extending portion 64, a cantilever-like spring piece 67 which is arcuately extended from the fixing portion 66 along the lower third opening 49 to be inclinedly projected from the bottom face of the frame 41 to the outside through the lower third opening 49, and in which a contact portion 58 is formed in a projected end portion so that the lower face is convex and the upper face is concave, and a solder pad portion 68 which is embedded in the resin of the extending portion 64 so that one surface is exposed substantially flushly with the upper face of the extending portion 64, and which is conductingly connected to the fixing portion 66 are integrally formed.

The spring pieces 67 of the external connection terminals 57 are projected in a V-like manner from the tip end sides of the extending portions 64 toward the attaching portion 63.

The lead wires 59, 60 are drawn out from the voice coil 55 to one side (the lower side of the sheet of FIG. 10) opposite of the insulating member 62, and then drawn out to the outsides of the two longitudinal yoke sidewalls sandwiching the attaching portion 63, through a gap between two places on the drawn-out sides of the lead wires 59, 60. In the external connection terminals 57, the solder pad portions 68 are exposed and placed on bottom portions outside the two longitudinal yoke sidewalls 45 sandwiching the attaching portion 63, and the lead wires 59, 60 are connected to the solder pad portions 68 by soldering.

Each of the external connection terminals 57 is fixed to the frame 41 by: previously forming a through hole (not shown) extending between the upper and lower faces in the attaching portion 63; forming a cylindrical raised portion 70 by a burring process around the first opening 47A which is below the attaching portion 63; when the attaching portion 63 is to be overlaid on one of the gaps between the yoke sidewalls 45 of the bottom plate 42, passing the raised portion 70 through the through hole from the lower face side of the attaching portion 63 to the upper face side; and applying a crushing process on an end portion of the raised portion 70 which is projected from the upper face of the attaching portion 63.

Also in the embodiment, the third openings 49 which are disposed in the bottom plate 42 by cutting and raising of the yoke sidewalls 45 from the bottom plate 42 are used as the rear sound holes for the speaker 50. In the case where the rear sound holes (third openings 49) are closed as result of surface mounting or the like, rear sound holes may be disposed in the sidewall 43 of the frame 41 in a similar manner as the first embodiment.

Also in the embodiment, in a similar manner as the first embodiment, a circular diaphragm ring 71 is bonded and fixed to the outer peripheral edge portion of the diaphragm 54, and the outer peripheral edge portion of the diaphragm 54 is bonded and fixed to the sidewall 43 through the diaphragm ring 71. A circular baffle 72 which covers an upper opening of the frame 41 is disposed. The baffle 72 is formed by performing a pressing process on a metal plate, and has a front sound hole 73 which is opposed to the diaphragm 54. A cylindrical edge portion 74 hangs from the outer peripheral edge portion of the baffle, and the edge portion 74 is fitted to the outside of the sidewall 43 to be coupled with the frame 41.

As apparent from the descriptions of Embodiments 1 and 2, the yoke-integral frame of the invention can be applied also to the rectangular or triangular speaker 10, the circular speaker 50, and a speaker having another shape such as an oval.

Hereinafter, Embodiments 3 and 4 of the invention will be described with reference to the drawings.

Embodiment 3

Figure 12:
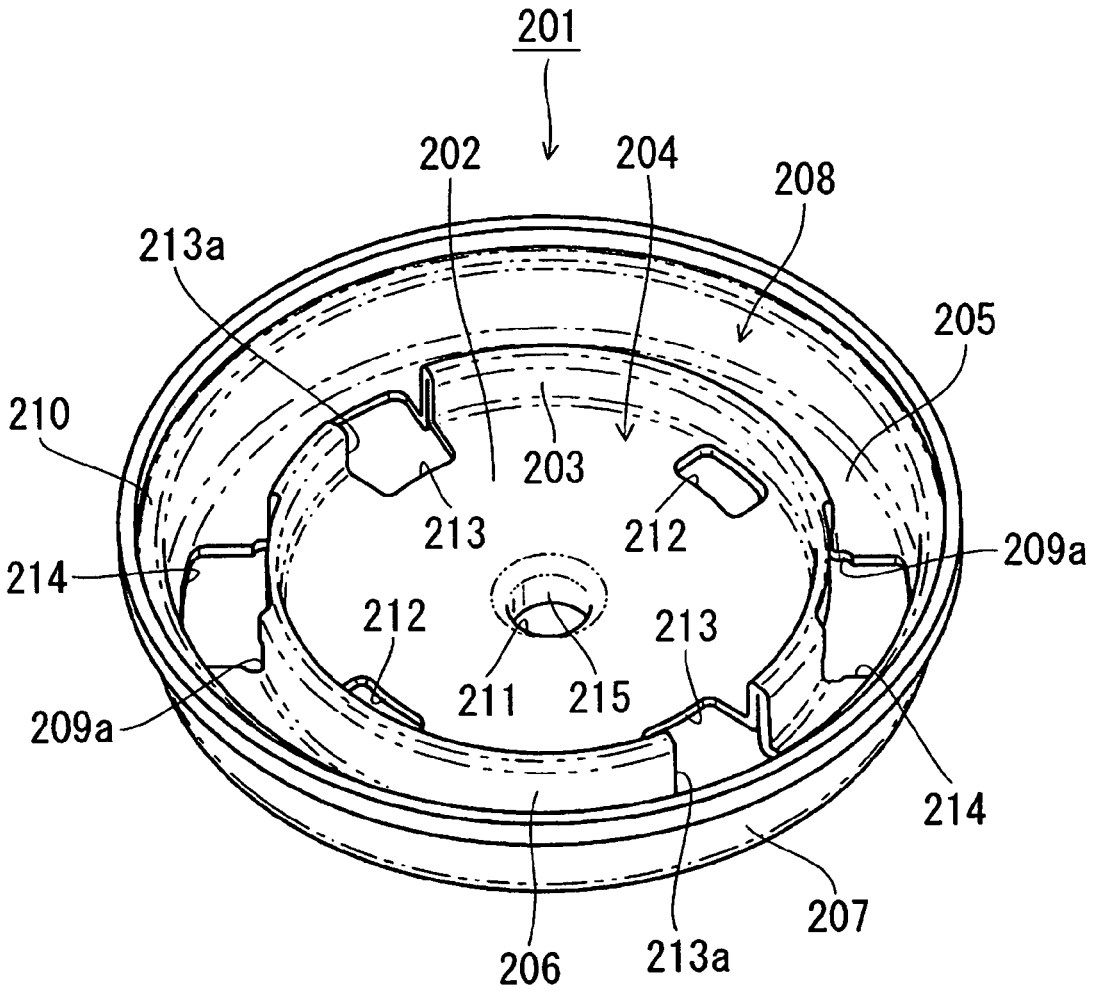
FIG. 12 is a perspective view of a frame in Embodiment 3 of the invention.

Embodiment 3 will be described with reference to FIGS. 12 to 23. FIG. 12 is a perspective view of a circular frame in an embodiment of the invention, FIG. 13 is a perspective view in which the frame of FIG. 12 is inverted, and FIG. 14 is a sectional view of the frame of FIG. 12.

Figure 13:
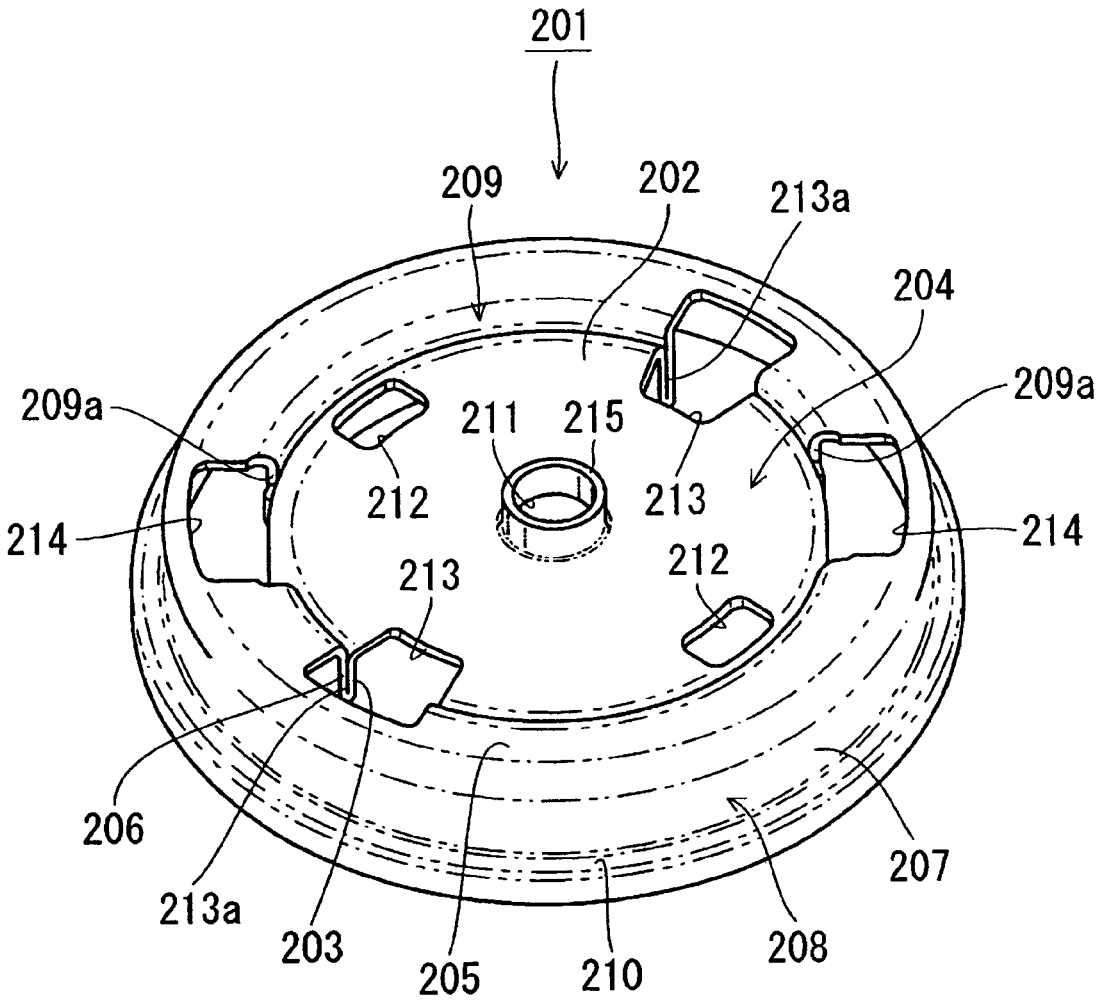
FIG. 13 is a perspective view in which the frame in Embodiment 3 of the invention is inverted.
Figure 14:
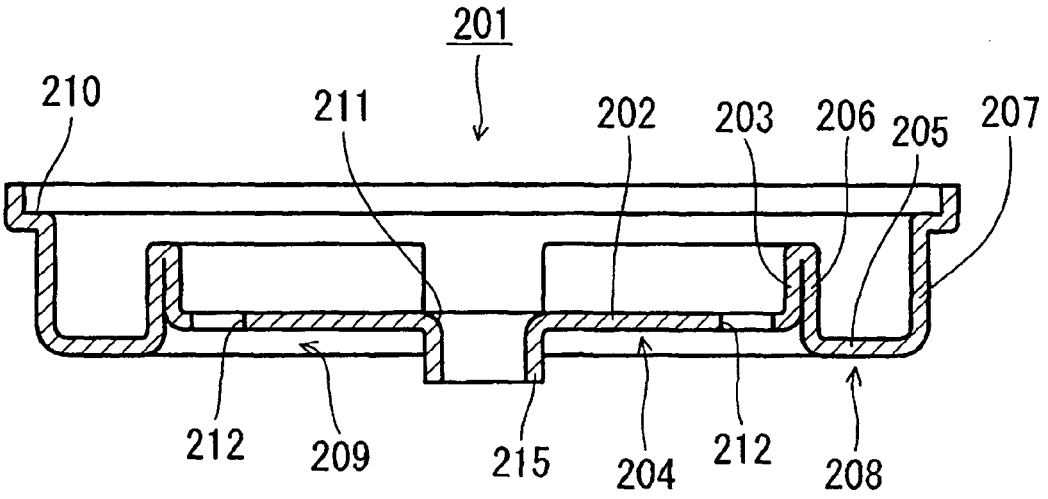
FIG. 14 is a sectional view of the frame in Embodiment 3 of the invention.

The frame 201 shown in FIGS. 12 to 14 is formed into a bottomed tubular shape by applying a drawing process on one sheet-like metal material to be formed into a bottomed tubular shape, and disposing a bottomed frame-like yoke portion inside by a drawing process, thereby being formed into a yoke-integral type.

In the yoke-integral frame 201, middle and peripheral portions of one sheet-like metal material are drawing-processed to raise a cylindrical outside wall from the outer peripheral edge of a disk-like bottom plate. A cylindrical double wall which is an inside wall that is smaller in diameter than and concentric with the outside wall, and which has a folded portion in an upper portion is raised from the bottom plate toward the inner side of the outside wall with forming a predetermined gap therefrom. A bottomed frame-like yoke portion 204 is formed by a circular yoke bottom plate 202 in which the inner wall of the double wall is raised from the outer peripheral edge, and which is configured by a middle portion of the bottom plate, and a cylindrical yoke sidewall 203 which is configured by the inner wall of the double wall. A bottomed annular frame portion 208 is formed in the periphery of the yoke portion 204 by: an annular frame bottom plate 205 formed by a bottom-plate peripheral edge portion in which the outer wall of the double wall is raised from the inner peripheral edge, and the outside wall is raised from the outer peripheral edge; a frame inside wall 206 which is configured by the outer wall of the double wall; and a frame outside wall 207 which is configured by the outside wall.

The frame bottom plate 205 is formed by lowering the yoke bottom plate 202 by one step. A shallow circular recess 209 is disposed in a middle portion of the rear face side (back face side) of the yoke-integral frame 1. The frame outside wall 207 is formed taller than the yoke sidewall 203 and the frame inside wall 206 (the double wall). A horizontal step portion 210 is disposed at a level which is higher than the yoke sidewall 203 of the frame outside wall 207 and the frame inside wall 206 (the double wall). A portion which is higher than the step portion 210 is formed to be larger in diameter than the lower portion.

Steps of processing the yoke-integral frame 201 include a boring process, and at least two or more (in the embodiment, seven) openings are disposed in the bottom plate of the frame 201. The followings are disposed: a circular first opening 211 which is formed in one place of a center portion of the yoke bottom plate 202, and which is concentric with the frame 201; a pair of second openings 212 which are formed in two point-symmetric places separated by 180° in an outer peripheral edge portion of the yoke bottom plate 202; a pair of third openings 213 which are in two point-symmetric places separated by 180° in an outer peripheral edge portion of the yoke bottom plate 202, which are extended radially outward from two point-symmetric places separated by 180° and positionally shifted by 90° in one direction from the pair of second openings 212, which are continuously formed to two point-symmetric places separated by 180° in an inner peripheral edge portion of the frame bottom plate 205, and in which a cutout 213*a* is formed in two point-symmetric places separated by 180° in the yoke sidewall 203 and the frame inside wall 206 (the double wall); and a pair of fourth openings 214 which are in two point-symmetric places separated by 180° in the frame bottom plate 205, which are extended radially inward from two point-symmetric places separated by 180° and positionally shifted by about 45° in one direction (the direction in which the pair of third openings 213 are shifted with respect to the pair of second openings 212) from the pair of third openings 213, which are formed to the upper end (the folded portion of the double wall) of the frame inside wall 206, and in which a cutout 209*a* is formed in two point-symmetric places separated by 180° in the outer peripheral wall (a lower portion of the frame inside wall 206 which is below the yoke bottom plate 202) of the recess 209.

The steps of processing the yoke-integral frame 201 further include a burring process. The first opening 212 is used as a lower hole for the burring process, and the periphery of the lower hole is raised by the burring process toward the rear face of the yoke bottom plate 202 to dispose a cylindrical raised portion 215 which is projected from a center portion of the yoke bottom plate 202 toward the rear face.

Figure 15:
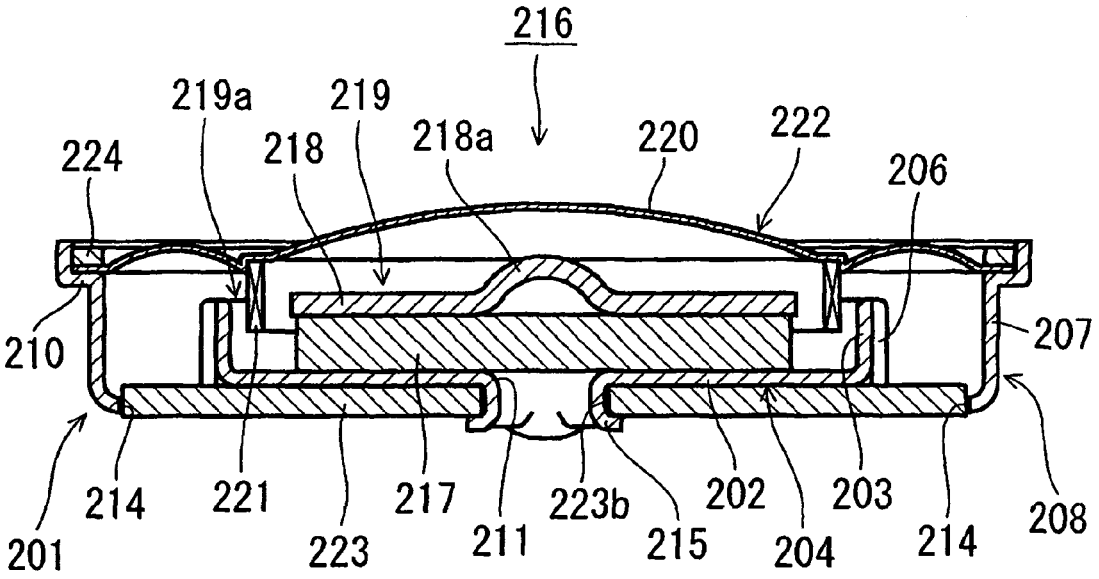
FIG. 15 is a sectional view of the speaker body (an example of the electroacoustic transducing device) assembled by using the frame in Embodiment 3 of the invention.
Figure 16:
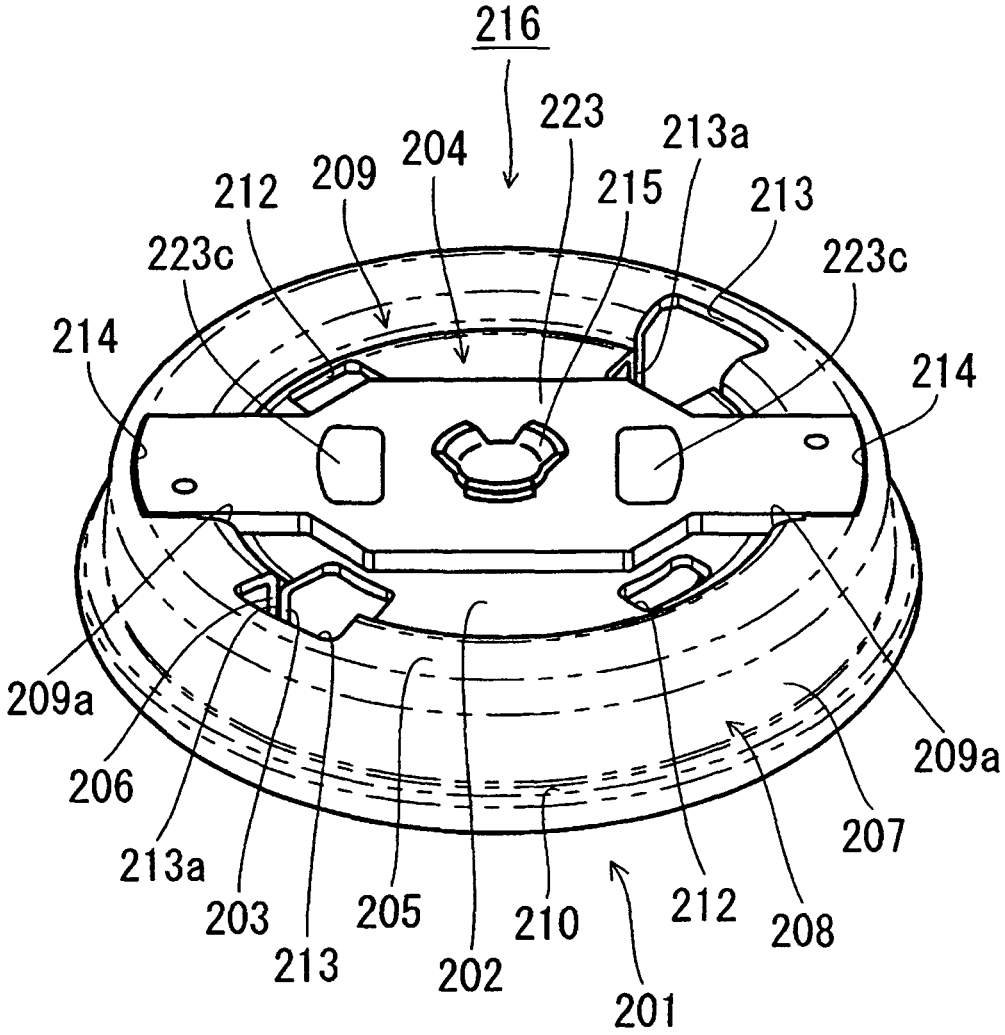
FIG. 16 is a perspective view in which the speaker body (an example of the electroacoustic transducing device) assembled by using the frame in Embodiment 3 of the invention is inverted.
Figure 17:
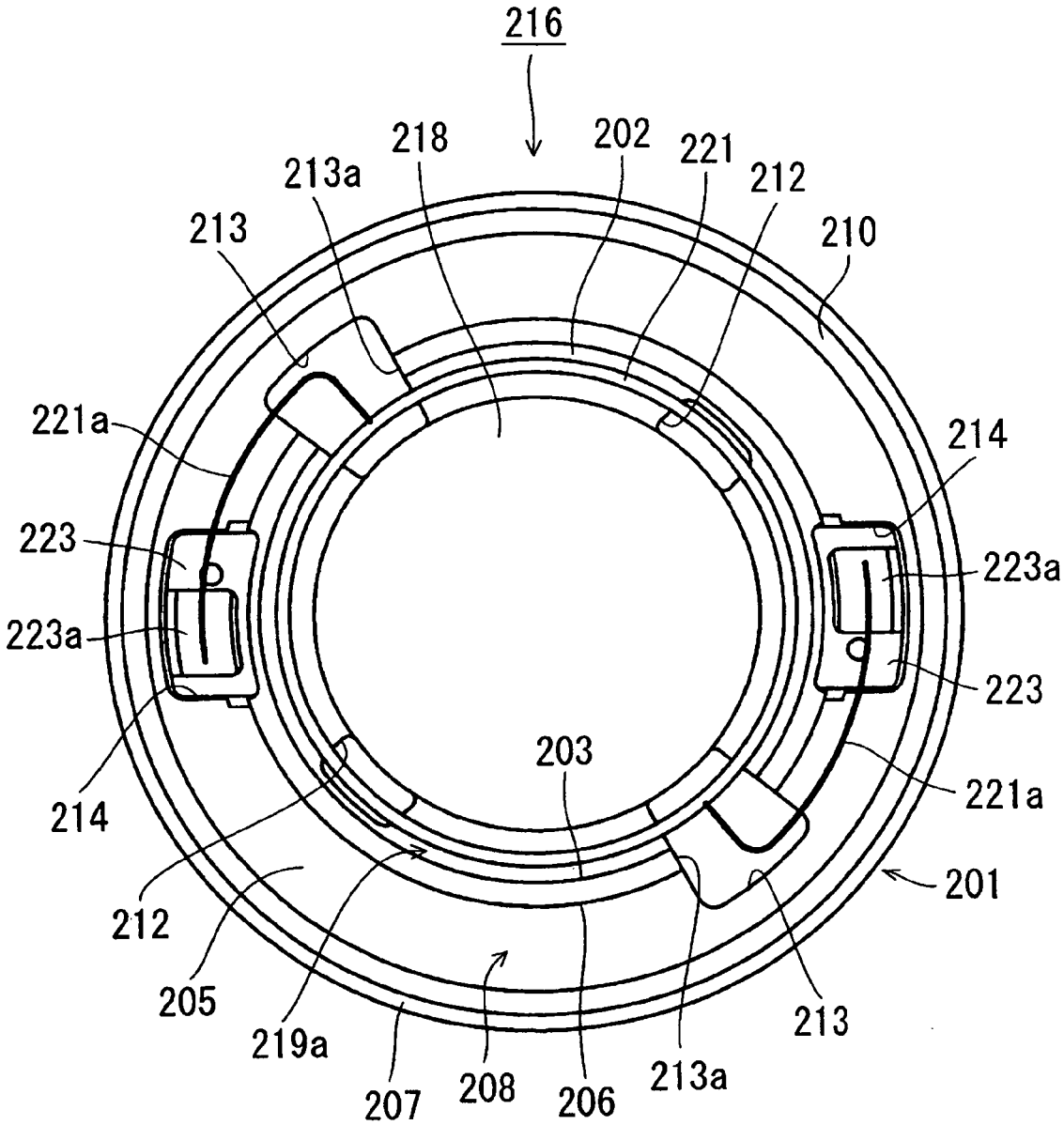
FIG. 17 is a plan view of a state where a diaphragm and diaphragm ring of the speaker body (an example of the electroacoustic transducing device) assembled by using the frame in Embodiment 3 of the invention are made transparent.

FIG. 15 is a sectional view of the circular speaker body (an example of the electroacoustic transducing device) assembled by using the circular yoke-integral frame shown in FIGS. 12 to 14, FIG. 16 is a perspective view in which the speaker body is inverted, and FIG. 17 is a plan view of a state where the diaphragm and diaphragm ring of the speaker body are made transparent.

In the speaker body 216 shown in FIGS. 15 to 17, a magnet 217 which is a columnar permanent magnet is bonded and fixed onto the yoke bottom plate 202, a pole piece 218 which is configured by a disk-like metal plate having a dome-like bulge portion 218*a* at a center portion is bonded and fixed onto the magnet 217, and the yoke portion 204, the magnet 217, and the pole piece 218 constitute an inner-yoke type magnetic circuit 219.

On the other hand, a circular diaphragm 220 which is configured by a resin or metal film, and a cylindrical voice coil 221 are concentrically bonded and fixed to each other, and the diaphragm 220 and the voice coil 221 constitute a vibration system 222.

The speaker body further comprises a printed wiring board 223 which forms external connection terminals fixed to the rear face side (back face side) of the yoke-integral frame 201, and which has a substantially rectangular plate-like shape.

Then, the speaker body 216 is assembled in the following manner. The printed wiring board 223 is fixed to the rear face side (back face side) of the yoke-integral frame 201, the magnet 217 is bonded and fixed onto the yoke bottom plate 202, and the pole piece 218 is bonded and fixed onto the magnet 217, thereby constituting the magnetic circuit 219. In a state where the voice coil 221 is supported from the lower side and coaxially placed in an annular magnetic gap 219*a* which is formed between the yoke sidewall 203 of the magnetic circuit 219 and the pole piece 218, thereafter, a process of guiding two lead wires 221*a* drawn out from the voice coil 221 to a pair of surface lands 223*a* of the printed wiring board 223, and a process of connecting the lead wires thereto by spot welding or soldering are performed. Then, the outer peripheral edge of the diaphragm 220 is overlaid from the upper side on the step portion 210 of the frame portion 208 to be bonded and fixed thereto, a diaphragm ring 224 is overlaid from the upper side on the outer peripheral edge of the diaphragm 220 to be bonded and fixed thereto, the outer peripheral edge of the diaphragm 220 is pressed from the upper side by the diaphragm ring 224 against the step portion 210 of the frame portion 208, thereby attaching the diaphragm 220 to the yoke-integral frame 201 so as to cover the upper opening of the frame. At this time, an upper portion of the voice coil 221 is bonded and fixed to the boundary between the middle dome portion of the diaphragm 220 and the peripheral edge portion, thereby constituting the vibration system 222. The magnetic circuit 219 and the vibration system 222 are integrally held by the yoke-integral frame 201.

The printed wiring board 223 is fixed to the yoke-integral frame 201 in the following manner. As shown in FIGS. 15 and 16, a circular mounting hole 223*b* is disposed in a center portion of the printed wiring board 223. The cylindrical raised portion 215 which is projected by a burring process from a center portion of the yoke bottom plate 202 toward the rear face side pierces through the mounting hole 223*b* of the printed wiring board 223. The end portions of the printed wiring board 223 are fitted into the pair of fourth openings 214. In a state where the printed wiring board 223 is overlaid on the rear face of the yoke-integral frame 201, a slotting process and a crushing process are applied on the tip end of the raised portion 215 which is projected toward the rear face side of the printed wire board 223. Then, the riveting fixation is performed.

In this way, the thickness of an intermediate portion of the printed wiring board 223 which is riveted to the rear face side of the yoke-integral frame 201 is absorbed by the recess 209, and, inside the pair of fourth openings 214 from the pair of 209*a*, the end portions of the board enter the bottom portion of the frame portion 208. The whole rear face is substantially flush with the rear face of the frame portion 208. As shown in FIG. 17, a pair of surface lands 223*a* are formed on the surfaces of the end portions of the printed wiring board 223 which are fitted into the bottom portion of the frame portion 208, and the pair of surface lands 223*a* are exposed and placed by the pair of fourth openings 214 on the bottom portion of the frame portion 208. The printed wiring board 223 has one rear face land 223*c* which is conductingly connected to the one surface land 223*a*, and another rear face land 223*c* which is conductingly connected to the other surface land 223*a*. The pair of rear face lands 223*c* are formed in two places which are on the rear face of the intermediate portion of the printed wiring board 223, and which are on the both sides of the mounting hole 223*b*, respectively.

In this way, the pair of fourth openings 214 of the yoke-integral frame 201 are used as positioning holes for the printed wiring board 223 which forms external connection terminals.

The voice coil 221 is supported by a centering jig which is a voice coil support member that is inserted into the yoke portion 204 from the rear face side of the yoke-integral frame 201 through the pair of second openings 212 and the pair of third openings 213.

In this way, the pair of second openings 212 and pair of third openings 213 of the yoke-integral frame 201 are used as insertion ports for the voice coil support member during the assembling process.

The process of guiding the two lead wires 221*a* drawn out from the voice coil 221 to the pair of surface lands 223*a* of the printed wiring board 223 is performed in the following manner. As shown in FIG. 17, the two lead wires 221*a* are drawn out from the voice coil 221 inside the pair of cutouts 213*a* of the yoke sidewall 203 and the frame inside wall 206 (the double wall). Then, the two lead wires 221*a* are drawn out from the yoke portion 204 to the surrounding frame portion 208 through the pair of cutouts 213*a*, and extended in one direction in the frame portion 208 to be guided to the corresponding surface lands 223*a*.

In this way, the pair of cutouts 213*a* (originally, the pair of third openings 213) which are disposed in the yoke sidewall 203 and frame inside wall 206 (the double wall) that are partition walls between the yoke portion 204 of the yoke-integral frame 201 and the surrounding frame portion 208 are used as lead wire drawn-out openings through which the two lead wires 221*a* of the voice coil 221 are drawn out from the yoke portion 204 where the voice coil 221 is disposed, to the frame portion 208 where the pair of surface lands 223*a* of the printed wiring board 223 that are connecting portions to be connected with the external connection terminals are disposed, and further to the pair of surface lands 223*a* of the printed wiring board 223.

The thus configured speaker body 216 is attached to a metal-made baffle, thereby forming a product (completed article) of a speaker.

Figure 18:
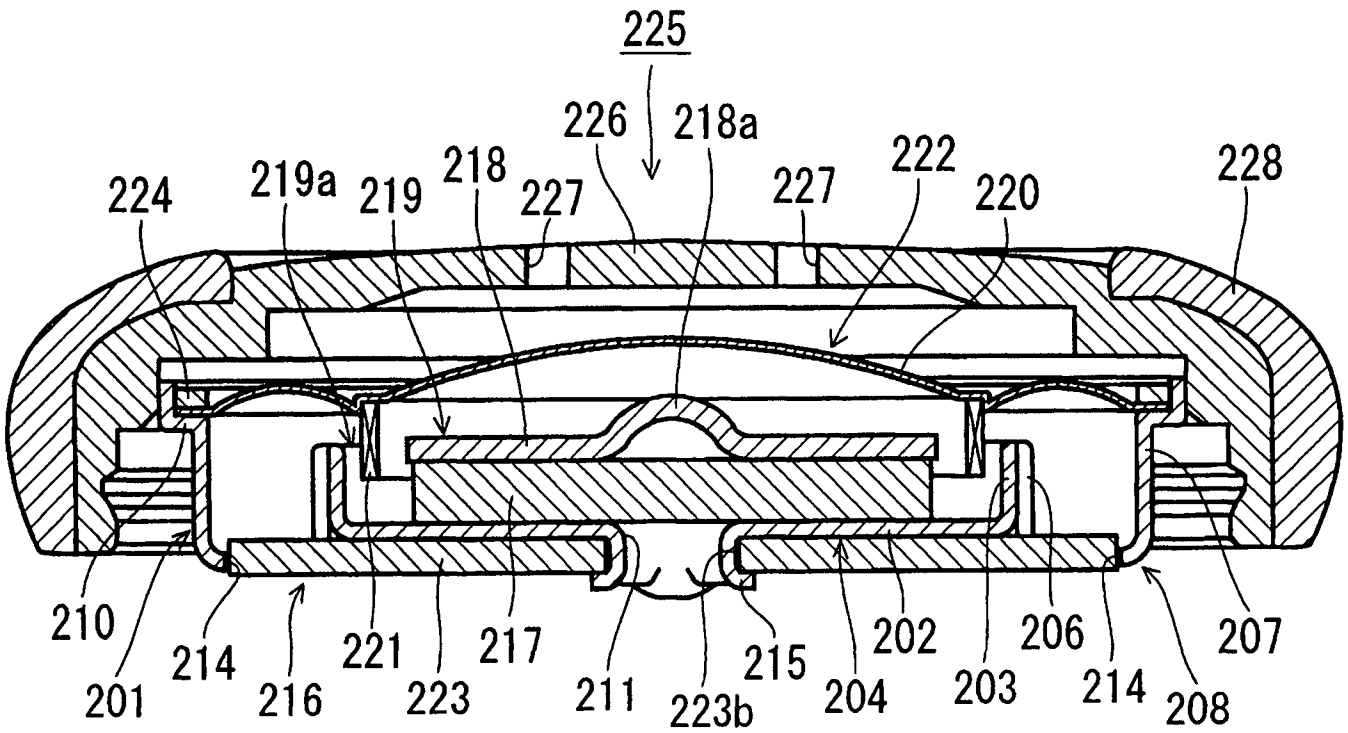
FIG. 18 is a sectional view of a speaker (a product: an example of the electroacoustic transducing device) in which the speaker body assembled by using the frame in Embodiment 3 of the invention is attached to a baffle.
Figure 19:
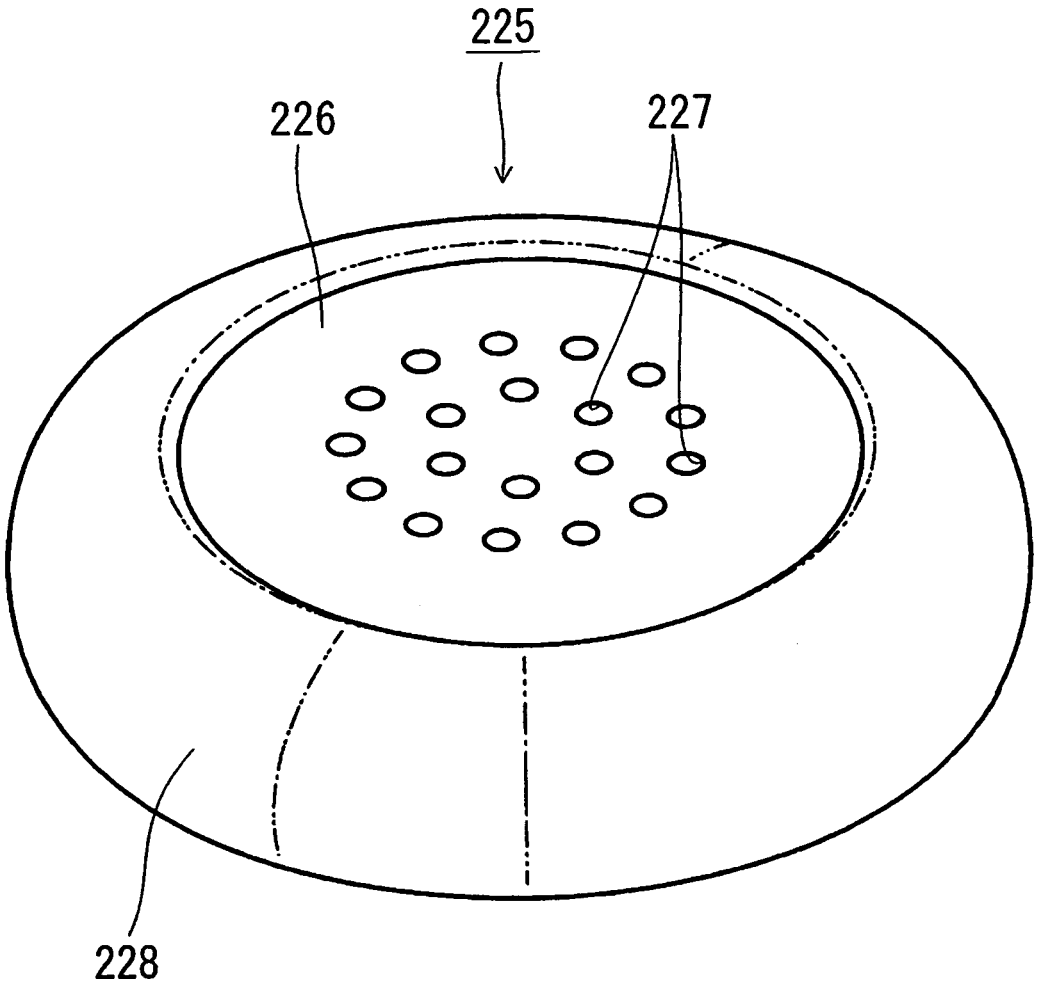
FIG. 19 is a perspective view of the speaker (a product: an example of the electroacoustic transducing device) in which the speaker body assembled by using the frame in Embodiment 3 of the invention is attached to a baffle.
Figure 20:
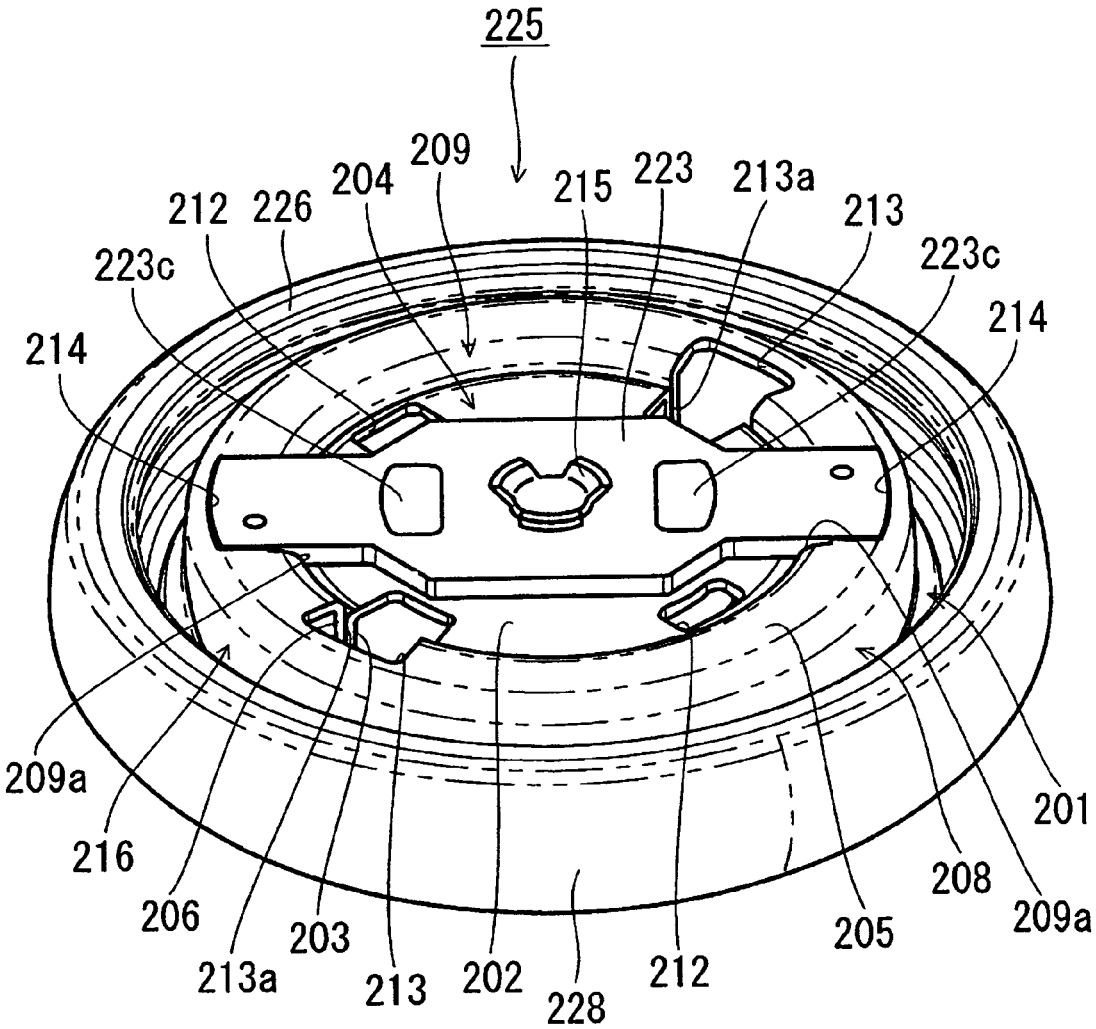
FIG. 20 is a perspective view in which the speaker (a product: an example of the electroacoustic transducing device) in which the speaker body assembled by using the frame in Embodiment 3 of the invention is attached to a baffle is inverted.

FIG. 18 is a sectional view of a circular speaker (product) in which the speaker body shown in FIGS. 15 to 17 is attached to a baffle, FIG. 19 is a perspective view of the speaker (product), and FIG. 20 is a perspective view in which the speaker (product) is inverted.

The speaker 225 shown in FIGS. 18 to 20 is configured by pressingly inserting the yoke-integral frame 201 of the speaker body 216 into a deep ceiled cylindrical baffle 226, so that a substantially total height of the speaker body 216 is attached into the baffle 226. The printed wiring board 223 is horizontally placed in the rear face side (back face side) of the speaker 225, and the rear face (rear face lands 223*c*) of the printed wiring board 223 is slightly projected from the lower end of the baffle 226 toward the rear face (back face) of the speaker 225. A gap where the vibration system 222 can vibrate with a sufficient stroke is formed between the diaphragm 220 of the speaker body 216 and the ceiling portion of the baffle 226. In the baffle 226, a front sound hole for the speaker 225 which is configured by many small holes 227 is disposed in the ceiling portion which is opposed to the middle dome portion of the diaphragm 220. A cover 228 for correcting the acoustic resistance of the speaker 225 is integrally formed on the outer side face of the baffle 226 by mold forming of an elastic material such as silicon rubber.

Figure 21:
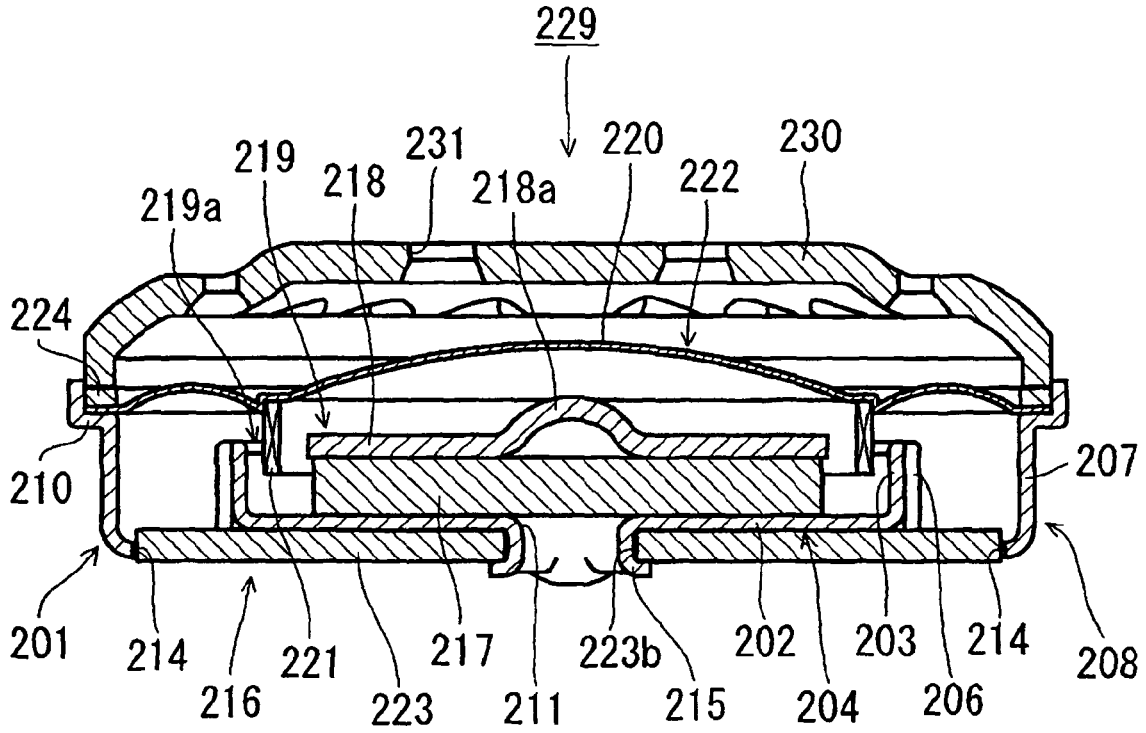
FIG. 21 is a sectional view of another speaker (a product: an example of the electroacoustic transducing device) in which the speaker body assembled by using the frame in Embodiment 3 of the invention is attached to a baffle.
Figure 22:
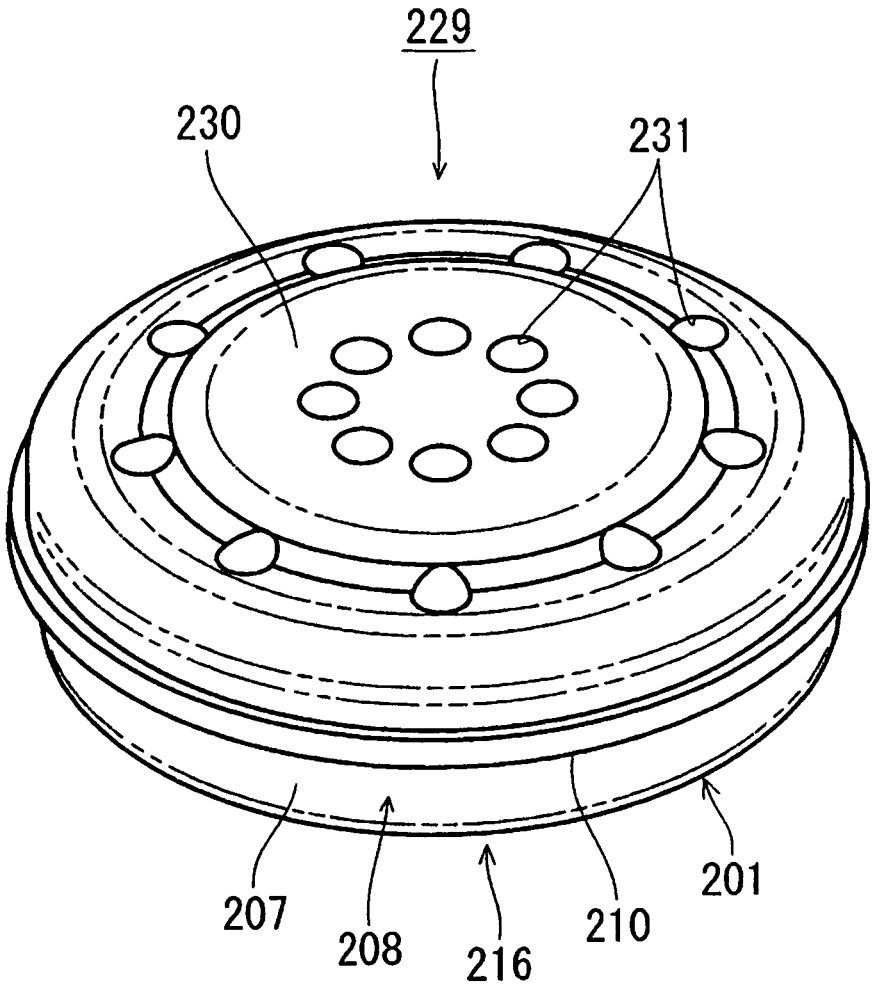
FIG. 22 is a perspective view of the other speaker (a product: an example of the electroacoustic transducing device) in which the speaker body assembled by using the frame in Embodiment 3 of the invention is attached to a baffle.
Figure 23:
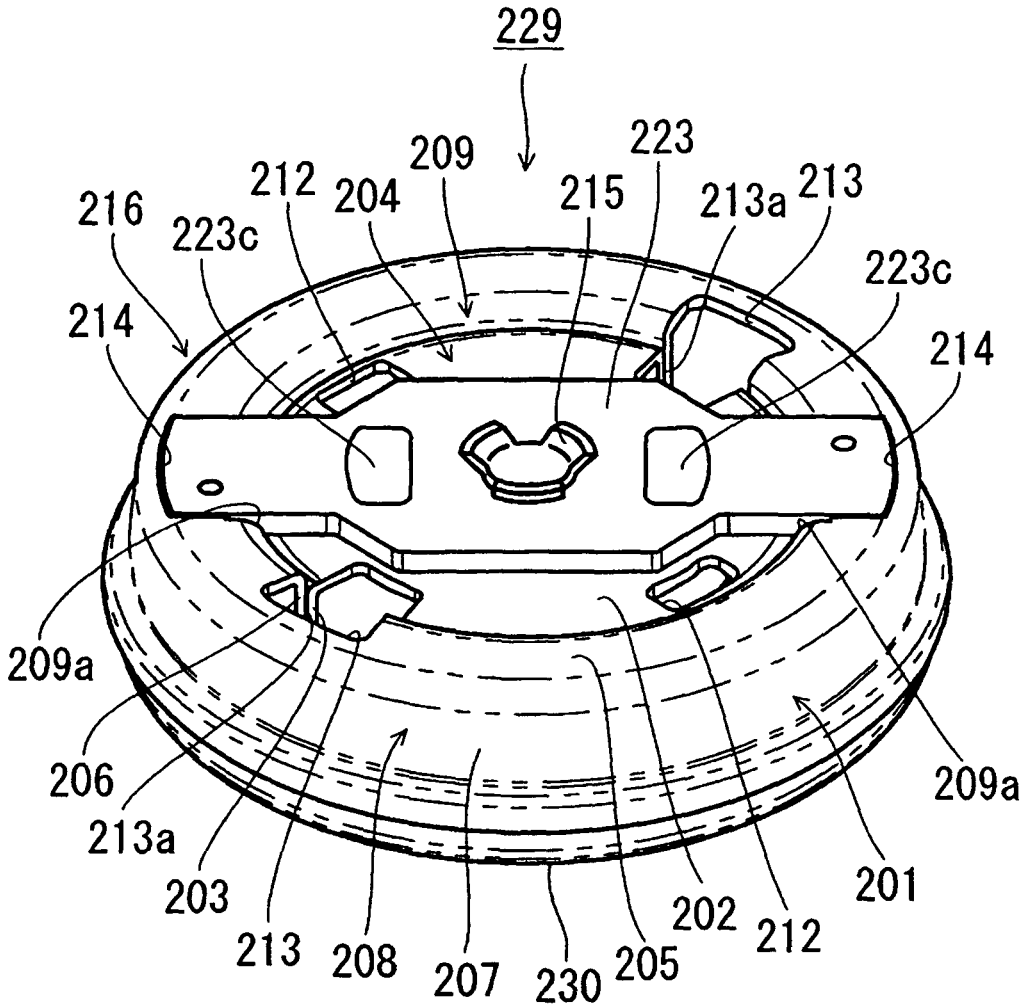
FIG. 23 is a perspective view in which the other speaker (a product: an example of the electroacoustic transducing device) in which the speaker body assembled by using the frame in Embodiment 3 of the invention is attached to a baffle is inverted.

FIG. 21 is a sectional view of another circular speaker (product) in which the speaker body shown in FIGS. 15 to 17 is attached to another baffle, FIG. 22 is a perspective view of the other speaker (product), and FIG. 23 is a perspective view in which the other speaker (product) is inverted.

The other speaker 229 shown in FIGS. 21 to 23 is configured by fitting a shallow rimmed lid-like baffle 230 into the yoke-integral frame 201 of the speaker body 216. The printed wiring board 223 is horizontally placed in the rear face side (back face side) of the other speaker 229. A gap where the vibration system 222 can vibrate with a sufficient stroke is formed between the diaphragm 220 of the speaker body 216 and the ceiling portion of the baffle 230. In the baffle 230, a front sound hole for the other speaker 229 which is configured by many small holes 231 is disposed in the ceiling portion which is opposed to the middle dome portion of the diaphragm 220.

The thus configured speaker 225 is used as, for example, a speaker (driver) of a headphone or an earphone, and the thus configured other speaker 229 is used as, for example, a speaker of a PC, a PDA, a digital camera, or a digital video camera. In the speaker 225 or 229, when an electric audio signal is supplied from an external circuit to the voice coil 221 through the pair of rear face lands 223*c* of the printed wiring board 223, the pair of surface lands 223*a* which are conductingly connected thereto, and the two lead wires 221*a* which are connected thereto, the interaction between the magnetic field generated in the magnetic circuit 219 and that generated by the signal input to the voice coil 221 causes the voice coil 221 to vertically vibrate, and, in accordance with this, the diaphragm 220 vertically vibrates to generate a sound through the front sound hole 227 or 231.

In this case, the internal pressure, i.e., the acoustic resistance of the yoke-integral frame 201 on the back face side of the diaphragm 220 is adjusted (corrected) by the sizes of the pair of second openings 212.

In this way, the pair of second openings 212 of the yoke-integral frame 201 are used as rear sound holes for correcting the acoustic resistance of the speaker 255 or 229.

As described above, according to the embodiment, the frame 201 is formed by performing a drawing process on one sheet-like metal material into a bottomed tubular shape, at least two openings are disposed in the bottom plate, and the bottomed frame-like yoke portion 204 is disposed inside by a drawing process, thereby being formed into a yoke-integral type. Therefore, the yoke-integral frame 201 can be formed not by cold forging as in the conventional art, but by a simple pressing process, the numbers of components and production steps of the speaker 255 or 229 can be reduced, and the productivity can be improved.

The yoke-integral frame 201 is formed by one sheet-like metal material. As compared with a conventional resin-made frame which is separated from a yoke, necessary strength can be easily ensured while the thickness is suppressed, and hence the speaker 255 or 229 can be further miniaturized and thinned.

Moreover, the rear sound holes formed by the pair of second openings 212 are disposed (as required, the number and sizes of the rear sound holes are changed), the external-connection terminal positioning holes formed by the pair of fourth openings 214 are disposed, the insertion ports 212 and 213 which are formed by the pair of second openings and the pair of third openings, and which are used for the voice coil support member during the assembling process are disposed, the cutouts 213*a* which are formed by the pair of third openings 213, and through which the lead wires 221*a* of the voice coil 221 are drawn out to the connecting portions 223*a* with the external-connection terminals 223 are disposed, the lower hole for the burring process formed by the single first opening (the center hole of the yoke-integral frame 201) is disposed, and the external-connection terminals 223 are coupled to the frame 201 by the burring process and the crushing process which crushes an end portion of the raised portion 215 formed by the burring process. In this way, the yoke-integral frame 201 can be provided with various functions by the opening which can be formed by a simple pressing process.

Embodiment 4

Figure 24:
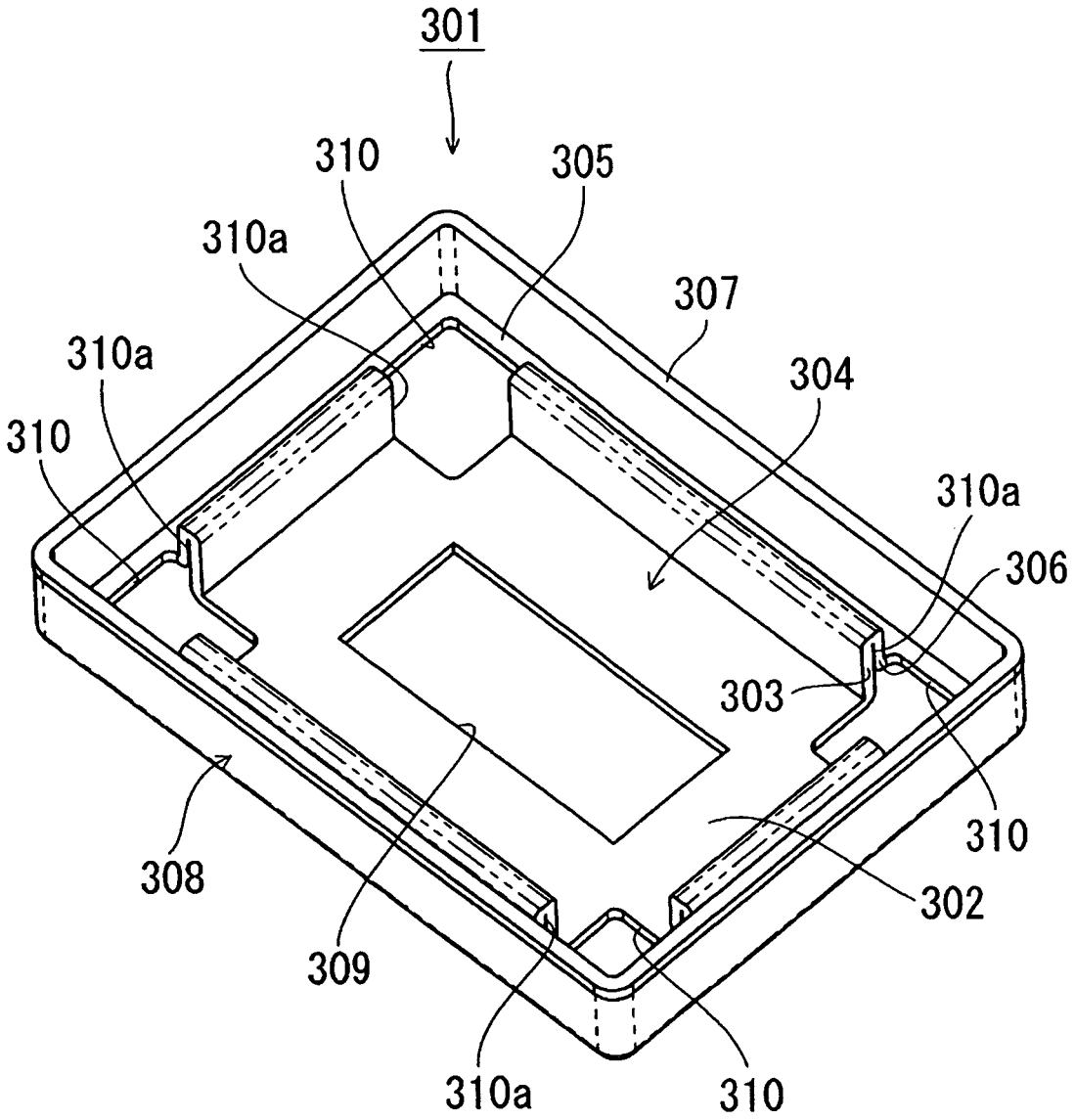
FIG. 24 is a perspective view of a frame in Embodiment 4 of the invention.

Then, Embodiment 4 will be described with reference to FIGS. 24 to 33. FIG. 24 is a perspective view of a rectangular frame in an embodiment of the invention, FIG. 25 is a perspective view in which the frame of FIG. 24 is inverted, FIG. 26(*a*) is a plan view of the frame of FIG. 24, FIG. 26(*b*) is a B-B sectional view, and FIG. 26(*c*) is a C-C sectional view.

Figure 25:
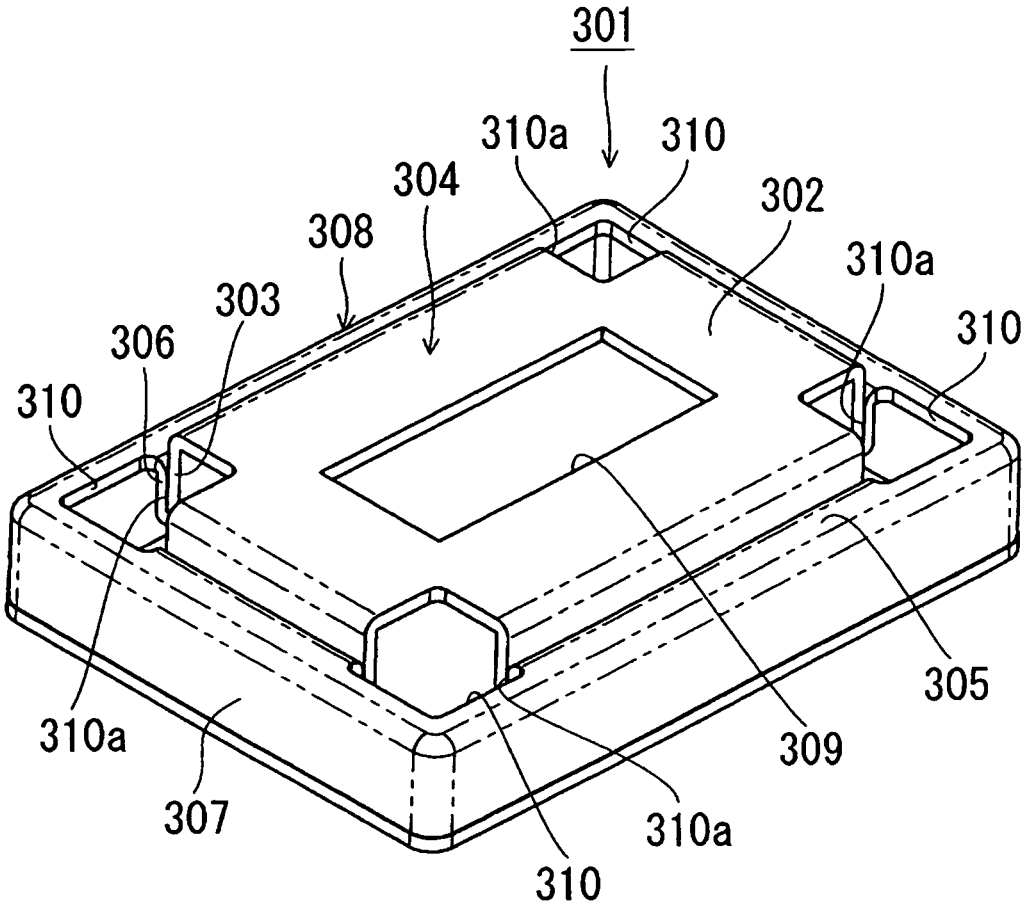
FIG. 25 is a perspective view in which the frame in Embodiment 4 of the invention is inverted.
Figure 26:
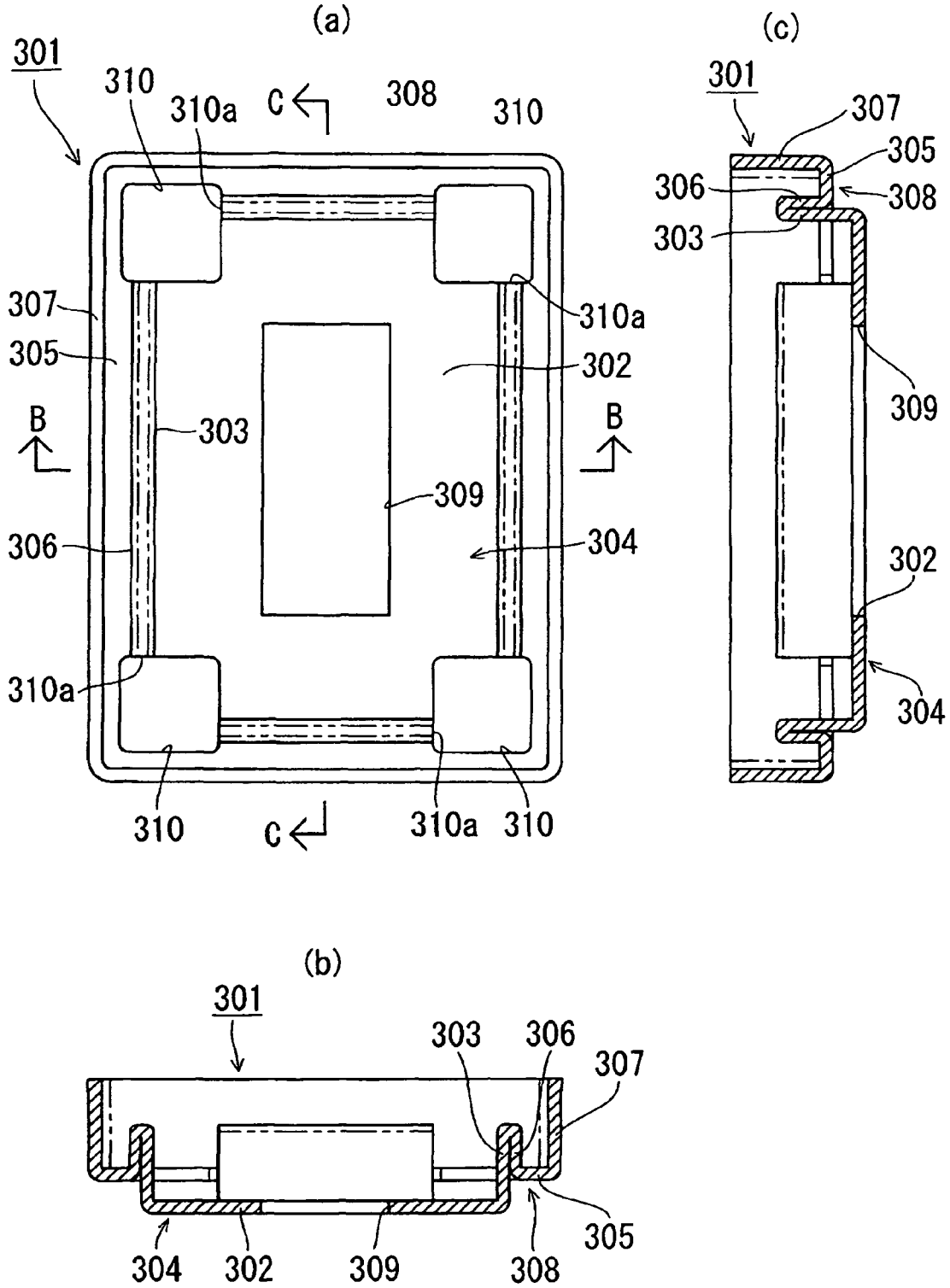
FIG. 26(*a*) is a plan view of the frame in Embodiment 4 of the invention, FIG. 26(*b*) is a B-B sectional view, and FIG. 26(*c*) is a C-C sectional view.

The frame 301 shown in FIGS. 24 to 26 is formed into a yoke-integral shape by applying a drawing process on one sheet-like metal material to be formed into a bottomed tubular shape, and disposing a bottomed frame-like yoke portion inside by a drawing process.

In the yoke-integral frame 301, middle and peripheral portions of one sheet-like metal material are drawing-processed to raise a rectangular tubular outside wall from the outer peripheral edge of a rectangular plate-like bottom plate. A rectangular tubular double wall which is an inside wall that is slightly smaller than and concentric with the outside wall, and which has a folded portion in an upper portion is raised from the bottom plate toward the inner side of the outside wall with forming a predetermined gap therefrom. A bottomed frame-like yoke portion 304 is formed by a rectangular plate-like yoke bottom plate 302 in which the inner wall of the double wall is raised from the outer peripheral edge, and which is configured by a middle portion of the bottom plate, and a rectangular tubular yoke sidewall 303 which is configured by the inner wall of the double wall. A bottomed annular frame portion 308 is formed in the periphery of the yoke portion 304 by an annular frame bottom plate 305 formed by a bottom-plate peripheral edge portion in which the outer wall of the double wall is raised from the inner peripheral edge, and the outside wall is raised from the outer peripheral edge, a frame inside wall 306 which is configured by the outer wall of the double wall, and a frame outside wall 307 which is configured by the outside wall.

In the yoke sidewall 303 and the frame inside wall 306, the length of the yoke sidewall 303 which extends from the upper folded portion is made larger than that of the frame inside wall 306 to form the yoke portion 304 with being lowered by one step from the frame portion 308, and the height of the frame outside wall 307 is made substantially equal to that of the yoke sidewall 303 to form the frame outside wall 307 to be taller than the frame inside wall 306.

Steps of processing the yoke-integral frame 301 include a boring process, and at least two or more (in the embodiment, five) openings are disposed in the bottom plate of the frame 301. A rectangular first opening 309 which is formed in one place of a center portion of the yoke bottom plate 302, and which is concentric with the frame 301, and four second openings 310 which are continuously formed from the four corners of the yoke bottom plate 302 to those of the frame bottom plate 305, and which form cutouts 310*a* in the four corners of the yoke sidewall 303 and the frame inside wall 306 (the double wall) are disposed. The yoke-integral frame 301 is formed in a 180° point symmetrical manner while setting the center as the point of symmetry.

Figure 27:
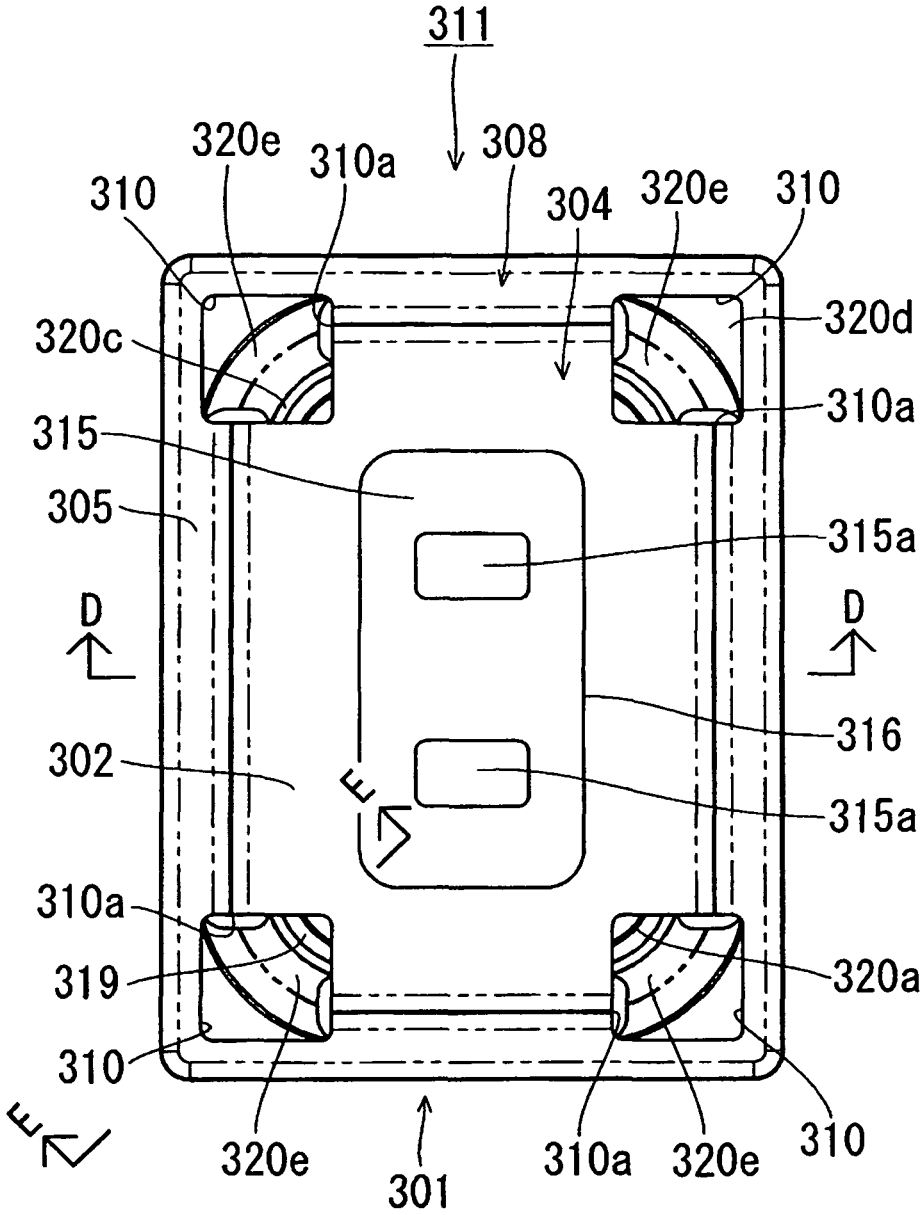
FIG. 27 is a bottom view of the speaker body (an example of the electroacoustic transducing device) assembled by using the frame in Embodiment 4 of the invention.
Figure 28:
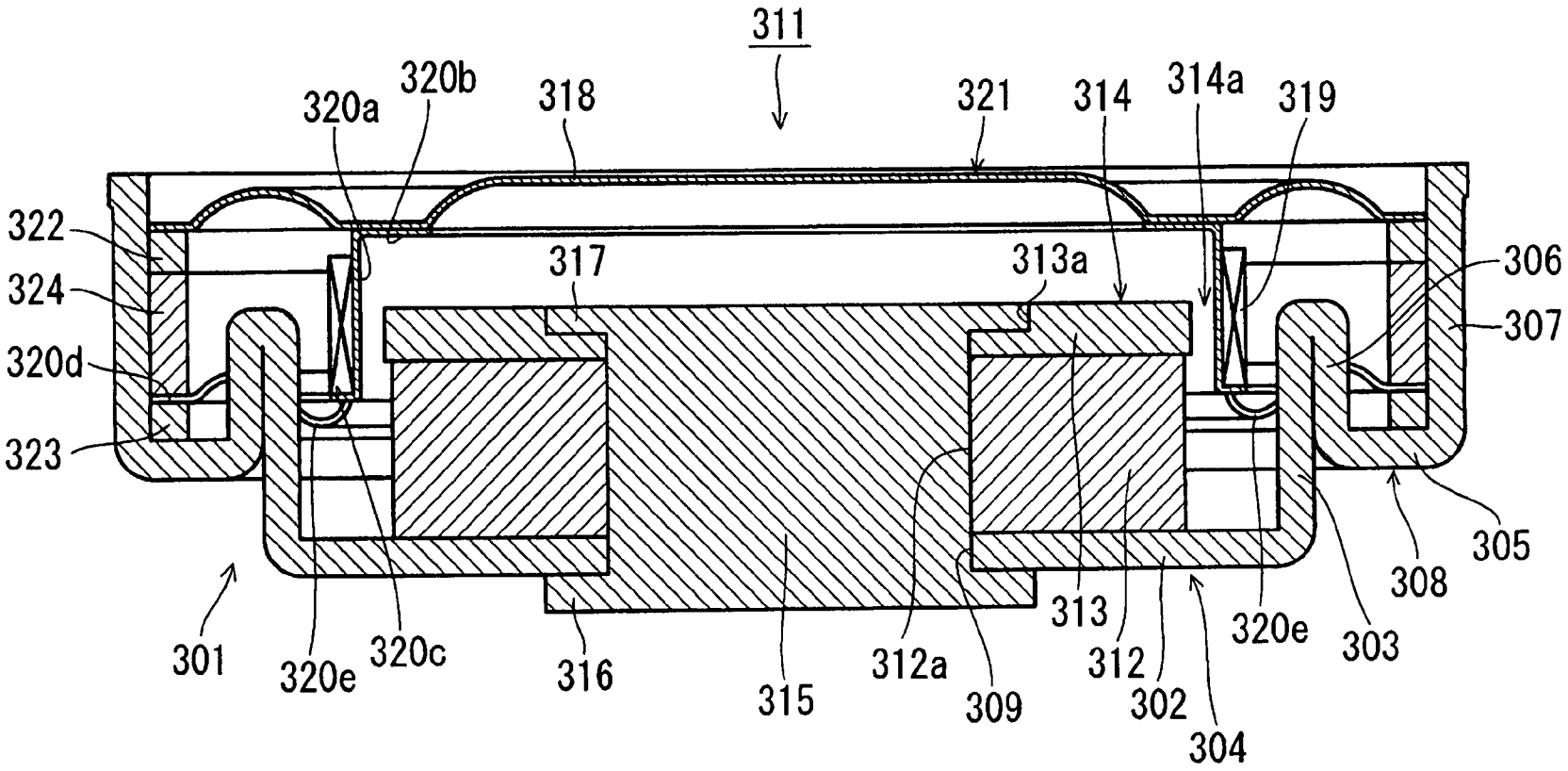
FIG. 28 is a sectional view of the speaker body (an example of the electroacoustic transducing device) assembled by using the frame in Embodiment 4 of the invention, taken along D-D of FIG. 27.
Figure 29:
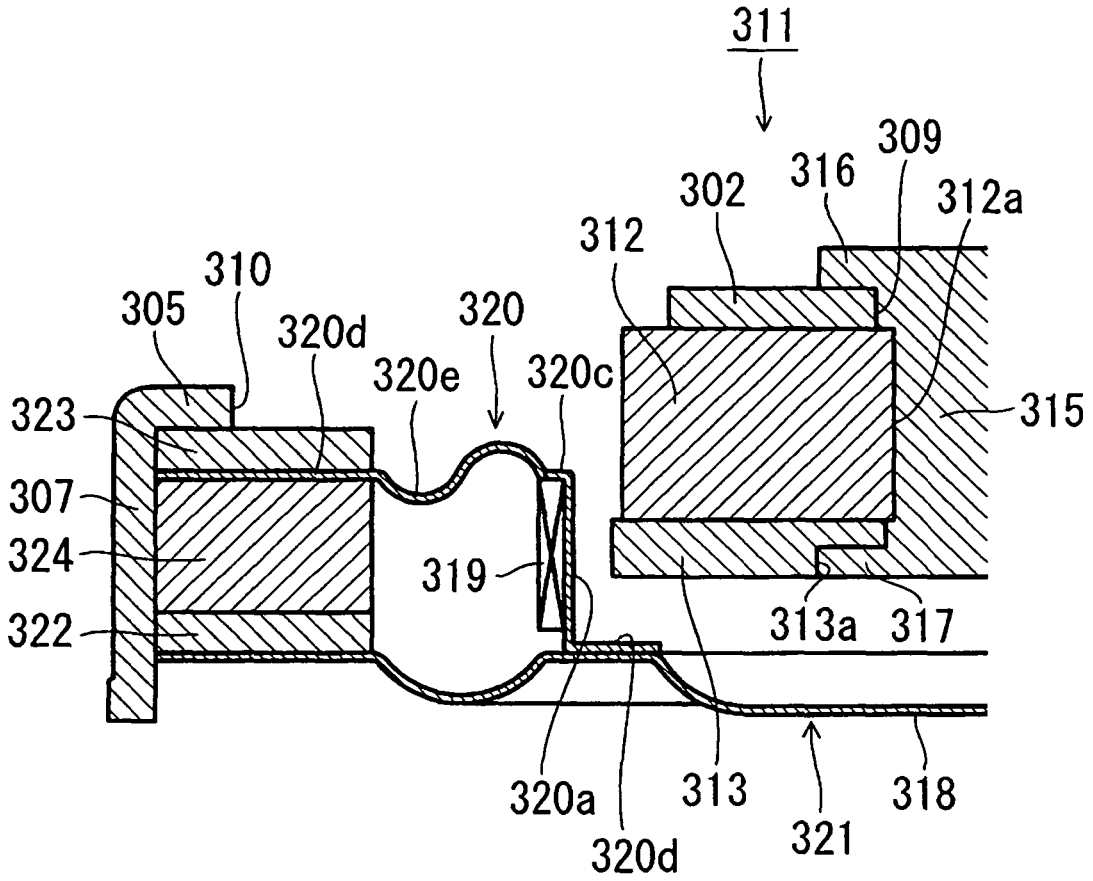
FIG. 29 is a sectional view of the speaker body (an example of the electroacoustic transducing device) assembled by using the frame in Embodiment 4 of the invention, taken along E-E of FIG. 27.
Figure 30:
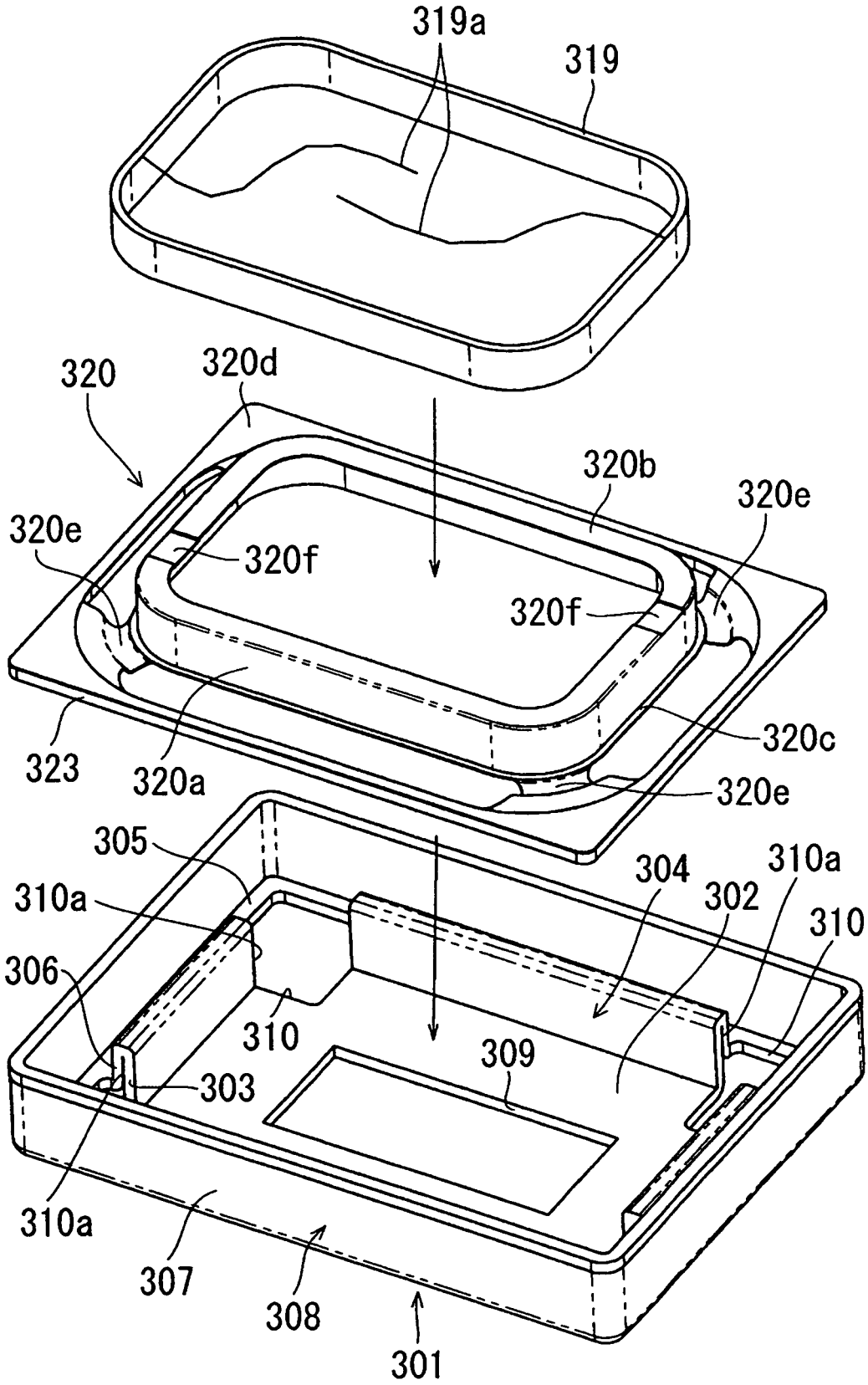
FIG. 30 is an assembly view of a voice coil of the speaker body (an example of the electroacoustic transducing device) assembled by using the frame in Embodiment 4 of the invention.

FIG. 27 is a bottom view of the rectangular speaker body (an example of the electroacoustic transducing device) assembled by using the rectangular yoke-integral frame shown in FIGS. 24 to 26, FIG. 28 is a sectional view taken along D-D of FIG. 27, FIG. 29 is a sectional view taken along E-E of FIG. 27, and FIG. 30 is an assembly view of the voice coil of the speaker body.

In the speaker body 311 shown in FIGS. 27 and 28, a magnet 312 which is a rectangular annular permanent magnet is bonded and fixed onto the yoke bottom plate 302, a pole piece 313 which is configured by a rectangular annular metal plate is bonded and fixed onto the magnet 312, and the yoke portion 304, the magnet 312, and the pole piece 313 constitute an inner-magnet type magnetic circuit 314.

In the magnetic circuit 314, a rectangular columnar printed wiring board 315 which forms external connection terminals is fitted into the first opening 309, a magnet inner hole 312*a*, and a pole piece inner hole 313*a* in the yoke bottom plate 302, the magnet 312, and the pole piece 313 in a stacked state. Centering of the yoke bottom plate 302, the magnet 312, and the pole piece 313 is performed by the printed wiring board 315. The yoke bottom plate 302, the magnet 312, and the pole piece 313 in the stacked state are clamped by a lower engaging portion 316 which extends horizontally outward from a lower end portion of the printed wiring board 315 protruded toward the rear face side (back face side) of the yoke bottom plate 302, and an upper engaging portion 317 which extends horizontally outward from an upper end portion of the printed wiring board 315 protruded toward the upper face of the pole piece 313. The yoke bottom plate 302, the magnet 312, and the pole piece 313 are integrally riveted. As shown in FIG. 27, preferably, the pole piece inner hole 313*a* is stepped so that the upper face engaging with the upper engaging portion 317 of the pole piece 313 is recessed by a degree corresponding to the thickness of the upper engaging portion 317, whereby the upper face of the pole piece 313 is made substantially flush with that of the printed wiring board 315.

A pair of upper face lands (not shown) are formed on the upper face of the printed wiring board 315. One lower face land 315*a* which is conductingly connected to the one upper face land, and another lower face land 315*a* which is conductingly connected to the other upper face land are formed on the lower face of the printed wiring board 315.

On the other hand, a rectangular diaphragm 318 which is configured by a resin or metal film, and a rectangular tubular voice coil 319 are concentrically bonded and fixed to each other through a voice coil/bobbin/damper 320 which is configured by a resin or metal film, and the diaphragm 318 and the voice coil 319 constitute a vibration system 312.

In the voice coil/bobbin/damper 320, as shown in FIG. 30, a rectangular tubular bobbin portion 320*a* onto which the voice coil 319 is fitted, a diaphragm boding piece portion 320*b* which extends horizontally inward from the upper end of the bobbin portion 320*a*, a voice coil bonding portion 320*c* which extends horizontally outward from the lower end of the bobbin portion 320*a*, and which is narrow, a rectangular annular base board portion 320*d* which is placed outside the voice coil bonding portion 320*c* with forming a predetermined gap, and damper portions 320*e* which are configured by four flexible pieces that are disposed between the four corners inside the base board portion 320*d* and those of the voice coil bonding portion 320*c*, and that have an S-like section shape are integrally formed. The voice coil/bobbin/damper is attached to the voice coil 319 in a state where the voice coil 319 is fitted onto the bobbin portion 320*a*, the inner peripheral face of the voice coil 319 is bonded and fixed to the outer peripheral face of the bobbin portion 320*a*, and the lower end face of the voice coil 319 is bonded and fixed to the upper face of the voice coil bonding portion 320*c*.

A diaphragm ring 322 is bonded and fixed from the rear side to an outer peripheral edge portion of the diaphragm 318, and a base board ring 323 is bonded and fixed from the rear side to an outer peripheral edge portion of the base board portion 320*d* of the voice coil/bobbin/damper 320.

Then, the speaker body 311 is assembled in the following manner. As shown in FIG. 17, the magnetic circuit 314 is formed in the yoke portion 304 of the yoke-integral frame 201. After the printed wiring board 315 is fixed, while the four damper portions 320*e* of the voice coil/bobbin/damper 320 attached to the voice coil 319 are fitted from the upper side into the cutouts 310*a* formed in the four corners of the yoke sidewall 303 and the frame inside wall 306 (the double wall), the base board portion 320*d* of the voice coil/bobbin/damper 320 is inserted into the frame portion 308, the bobbin portion 320*a* of the voice coil/bobbin/damper 320 and the voice coil 319 are inserted into a rectangular annular magnetic gap 314*a* of the magnetic circuit 314 formed between the yoke sidewall 303 and the pole piece 313. The base board ring 323 of the voice coil/bobbin/damper 320 is bonded and fixed to the frame bottom plate 305. In the state where the voice coil 319 is coaxially placed in the magnetic gap 314*a* of the magnetic circuit 314 through the voice coil/bobbin/damper 320, a process of guiding two lead wires 319*a* drawn out from the voice coil 319 to a pair of upper surface lands of the printed wiring board 315, and a process of connecting the lead wires thereto by spot welding or soldering are performed. Then, a rectangular annular spacer 324 is overlaid on the base board ring 323 from the upper side of the base board portion 320*d* of the voice coil/bobbin/damper 320, and thereafter the diaphragm ring 322 of the diaphragm 318 is overlaid on the spacer 324, thereby attaching the diaphragm 318 to the upper opening of the yoke-integral frame 301 so as to cover it. At this time, the voice coil bonding portion 320*c* of the voice coil/bobbin/damper 320 is bonded and fixed to the boundary between the middle dome portion of the diaphragm 318 and the peripheral edge portion, thereby constituting the vibration system 321. The magnetic circuit 314 and the vibration system 321 are integrally held by the yoke-integral frame 301.

The process of guiding the two lead wires 319*a* drawn out from the voice coil 319 to the pair of upper face lands of the printed wiring board 315 is performed in the following manner. As shown in FIG. 30, the two lead wires 319*a* are drawn out from the voice coil 319 outside a pair of recess portions 320*f* which are formed in two point-symmetric places separated by 180° in the diaphragm boding piece portion 320*b* of the voice coil/bobbin/damper 320. The two lead wires 319*a* are guided to the pair of upper face lands of the printed wiring board 315 through the upper side of the pair of recess portions 320*f*. The voice coil bonding portion 320*c* of the voice coil/bobbin/damper 320 is bonded and fixed to the boundary between the middle dome portion of the diaphragm 318 and the peripheral edge portion other than the pair of recess portions 320*f*, so that through holes for the two lead wires 319*a* of the voice coil 319 are formed by the pair of recess portions 320*f* (non-bonding portions).

The thus configured speaker body 311 is attached to a metal-made baffle, thereby forming a product (completed article) of a speaker.

Figure 31:
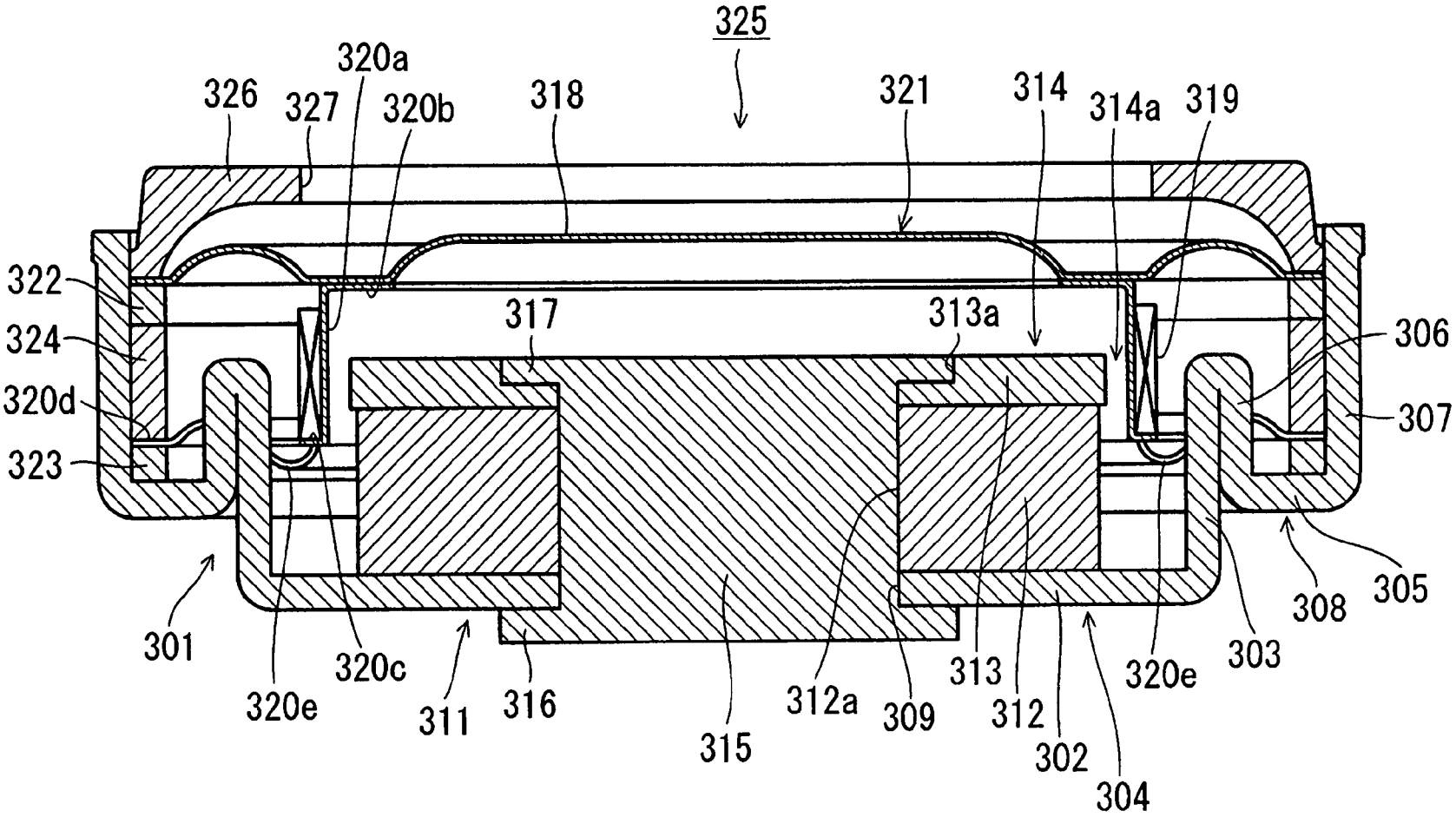
FIG. 31 is a sectional view of a rectangular speaker (a product: an example of the electroacoustic transducing device) in which the speaker body assembled by using the frame in Embodiment 4 of the invention is attached to a baffle.
Figure 32:
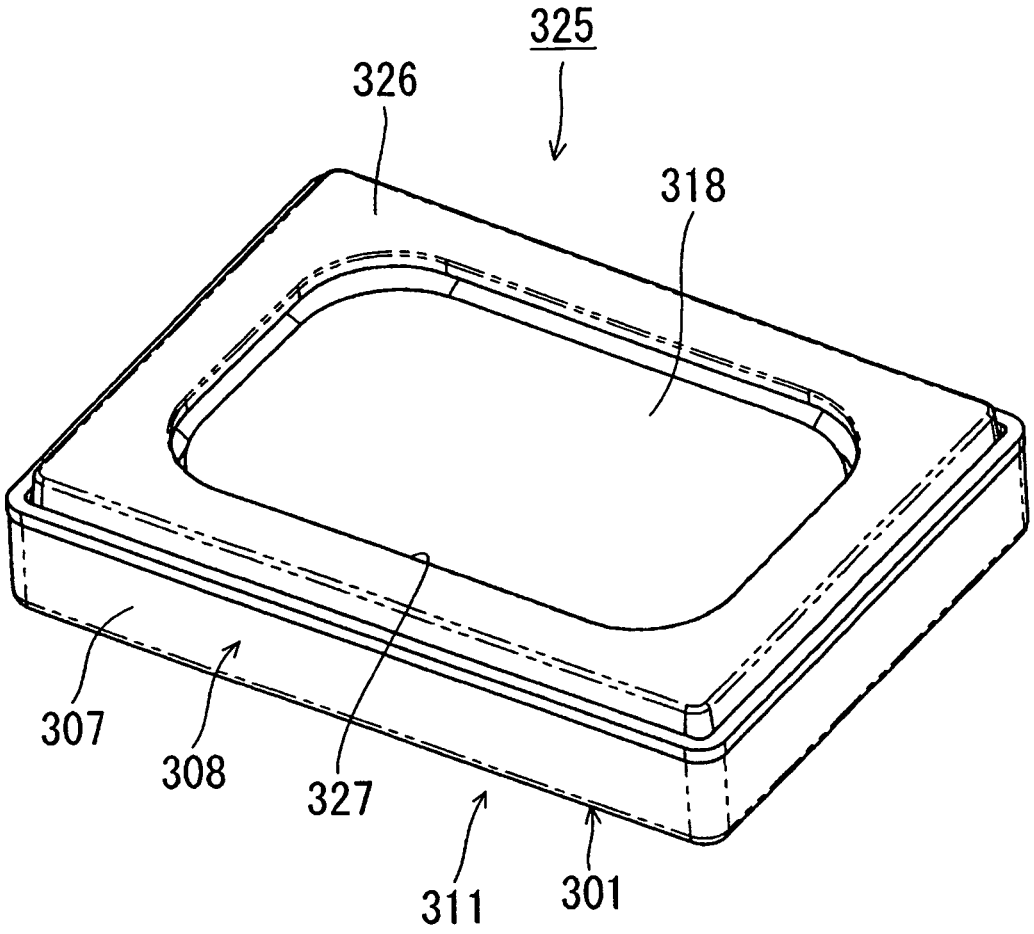
FIG. 32 is a perspective view of the speaker (a product: an example of the electroacoustic transducing device) in which the speaker body assembled by using the frame in Embodiment 4 of the invention is attached to a baffle.
Figure 33:
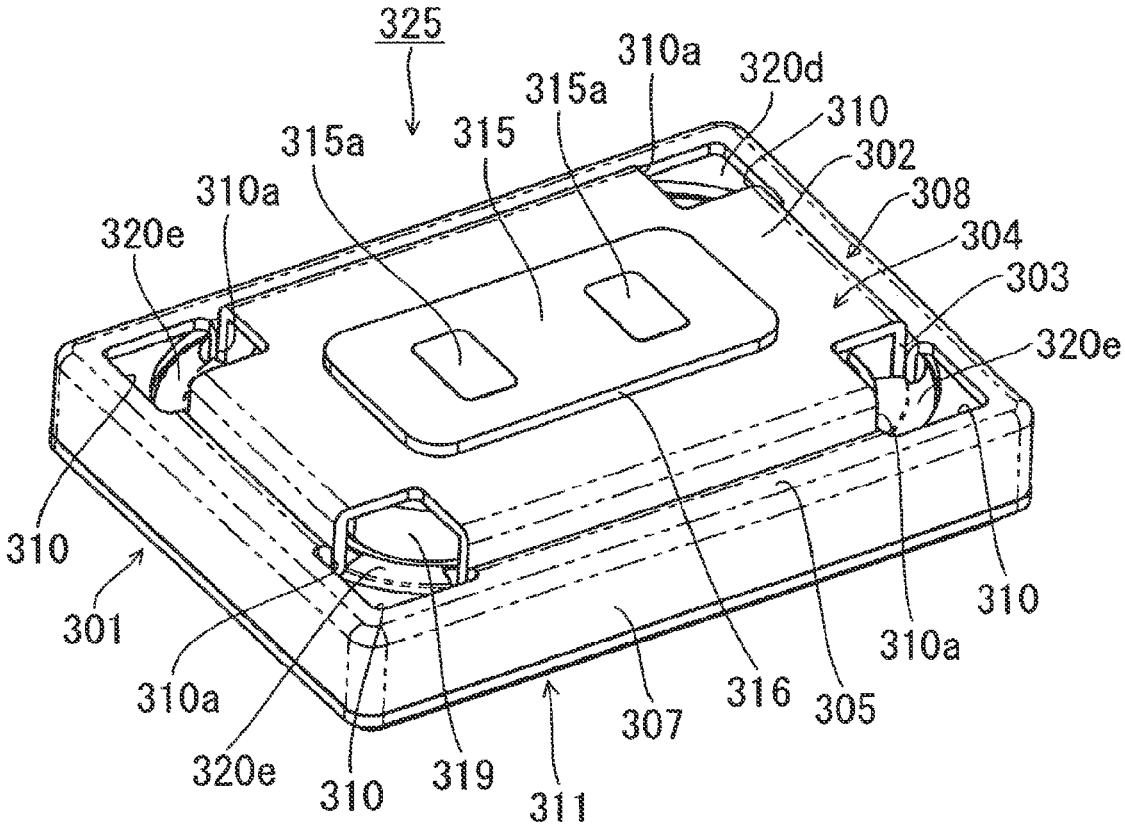
FIG. 33 is a perspective view in which the speaker (a product: an example of the electroacoustic transducing device) in which the speaker body assembled by using the frame in Embodiment 4 of the invention is attached to a baffle is inverted.
Figure 34:
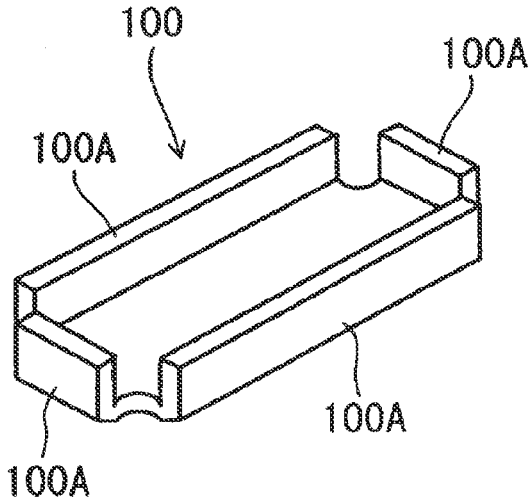
Fig. 34 Prior Art
FIG. 34 is a perspective view of a conventional yoke.
Figure 35:
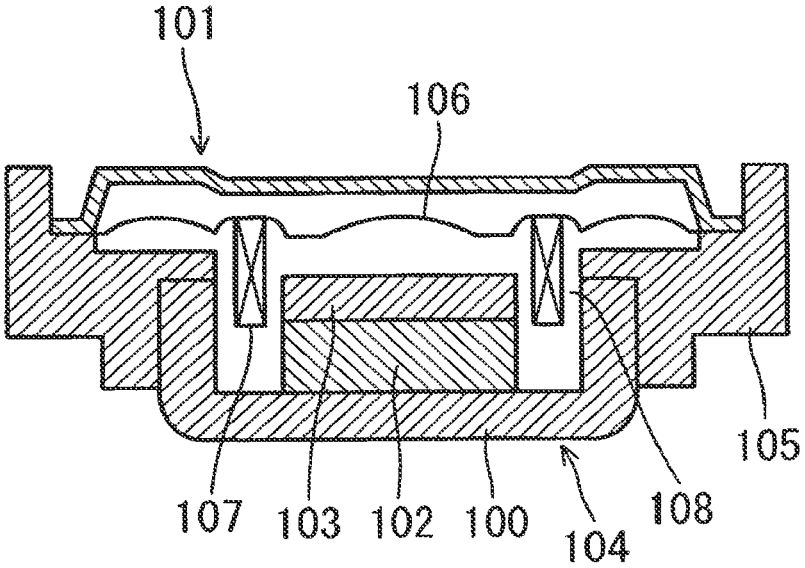
Fig. 35 Prior Art
FIG. 35 is a sectional view of a conventional speaker.

FIG. 31 is a sectional view of a rectangular speaker (product) in which the speaker body shown in FIGS. 27 and 28 is attached to a baffle, FIG. 32 is a perspective view of the speaker (product), and FIG. 33 is a perspective view in which the speaker (product) is inverted.

The speaker 325 shown in FIGS. 31 to 33 is configured by fitting a shallow rimmed lid-like baffle 326 into the yoke-integral frame 301 of the speaker body 311. A lower face land 315*a* of the printed wiring board 315 is exposed and placed on the rear face side (back face side) of the speaker 325. A gap where the vibration system 321 can vibrate with a sufficient stroke is formed between the diaphragm 318 of the speaker body 325 and the ceiling portion of the baffle 326. In the baffle 326, a front sound hole 327 for the speaker 325 which is configured by a single large hole is disposed in the ceiling portion which is opposed to the middle dome portion of the diaphragm 318.

The thus configured speaker 325 is used as, for example, a speaker of a PC, a PDA, a digital camera, or a digital video camera. In the speaker 325, when an electric audio signal is supplied from an external circuit to the voice coil 319 through the pair of rear face lands 315*a* of the printed wiring board 315, the pair of upper face lands which are conductingly connected thereto, and the two lead wires 319*a* which are connected thereto, the interaction between the magnetic field generated in the magnetic circuit 314 and that generated by the signal input to the voice coil 319 causes the voice coil 319 to vertically vibrate, and, in accordance with this, the diaphragm 318 vertically vibrates to generate a sound through the front sound hole 327.

At this time, the voice coil/bobbin/damper 320 holds the voice coil 319 at a correct position so as to enable the voice coil to perform correct piston motion (vibration). The four damper portions 320*e* support the bobbin portion 320*a* from the lower side. Therefore, it is not necessary to additionally ensure a space for installing a damper, and hence the resistance to input can be improved without impairing the thinness of the small speaker 325.

The air flows through the gaps between the damper portions 320*e*, and hence the voice coil/bobbin/damper 320 itself is not required to have air permeability. Moreover, the damper portions 320*e* support from the lower side the bobbin portion 320*a*, and hence the damper portions 320*e* can be formed integrally with the bobbin portion 320*a*, irrespective of whether the bobbin portion 320*a* is formed integrally with or separately from with the diaphragm 318. Therefore, the resistance to input can be improved while suppressing the increase of the production cost of the small speaker 325.

When the tip end portions of the four damper portions 320*e* are coupled together by the base board portion 320*d*, the stability in the configuration in which the bobbin portion 320*a* is supported from the lower side by the damper portions 320*e* is enhanced, and the attaching of the damper portions 320*e* to the yoke-integral frame 301 can be performed with high workability. Therefore, the mass productivity can be enhanced.

As described above, according to the embodiment, the frame 301 is formed by performing a drawing process on one sheet-like metal material into a bottomed tubular shape, at least two openings are disposed in the bottom plate, and the bottomed frame-like yoke portion 304 is disposed inside by a pressing process, thereby being formed into a yoke-integral type. Therefore, the yoke-integral frame 301 can be formed not by cold forging as in the conventional art, but by a simple pressing process, the numbers of components and production steps of the speaker 325 can be reduced, and the productivity can be improved.

The yoke-integral frame 301 is formed by one sheet-like metal material. As compared with a conventional resin-made frame which is separated from a yoke, necessary strength can be easily ensured while the thickness is suppressed, and hence the speaker 325 can be further miniaturized and thinned.

Moreover, the second openings 310 can be used as rear sound holes, the first opening 309 can be used as an external-connection terminal positioning hole, and the voice coil/bobbin/damper 320 in which the cutouts 310*a* formed by the second openings 310 allow the four damper portions 320*e* to support the bobbin portion 320*a* from the lower side can be employed.

The invention claimed is:

1. An electroacoustic transducing device, comprising:

a magnetic circuit having a yoke, a magnet, and a pole piece;

a vibration system having a diaphragm and a voice coil; and a yoke-integrally-formed-type frame which holds said magnetic circuit and said vibration system, said voice coil being placed in a magnetic gap, wherein:

said frame is formed by drawing one sheet-like metal material into a shape having a bottom plate with at least two openings disposed in said bottom plate, a plurality of upstanding side walls extending from said bottom plate and raised from a circumference of an outer peripheral edge of said bottom plate, and a bottom frame-like yoke portion disposed inside of said plurality of upstanding side walls and having a yoke bottom plate and yoke sidewalls raised from said bottom plate disposed in opposition to an inside of said plurality of upstanding side walls and formed, by a pressing process, into said yoke-integrally-formed-type frame, wherein proximal ends of yoke sidewalls at said bottom plate define a side of respective openings, wherein said yoke bottom plate is disposed between respective yoke sidewalls.

2. An electroacoustic transducing device, comprising:

a magnetic circuit having a yoke, a magnet, and a pole piece;

a vibration system having a diaphragm and a voice coil; and a yoke-integrally-formed-type frame which holds said magnetic circuit and said vibration system, said voice coil being placed in a magnetic gap, wherein:

said frame is formed by drawing one sheet-like metal material into a shape having a bottom plate, a plurality of upstanding side walls extending from said bottom plate and raised from a circumference of an outer peripheral edge of said bottom plate, and at least two places of said bottom plate being cut and raised to form a bottomed frame-like yoke portion having a yoke bottom plate and yoke sidewalls raised from said bottom plate, the yoke sidewalls of the frame-like yoke portion being disposed in opposition to an inside of said upstanding side walls and, thereby being formed by a pressing process into said yoke-integrally-formed-type frame, wherein proximal ends of yoke sidewalls at said bottom plate define a side of one or more openings, wherein said yoke bottom plate is disposed between respective yoke sidewalls.

3. An electroacoustic transducing device, comprising:

a magnetic circuit having a yoke, a magnet, and a pole piece;

a vibration system having a diaphragm and a voice coil; and a yoke-integrally-formed-type frame which holds said magnetic circuit and said vibration system, said voice coil being placed in a magnetic gap, wherein:

said frame is formed by drawing one sheet-like metal material into a shape having a bottom plate, a plurality of upstanding side walls extending from said bottom plate and raised from a circumference of an outer peripheral edge of said bottom plate, at least two openings disposed in said bottom plate, and a bottom frame-like yoke portion disposed inside of said plurality of upstanding side walls by a drawing process, and disposed in opposition to said plurality of upstanding side walls, and thereby being formed by a pressing process into said yoke-integrally-formed-type frame, wherein the bottom frame-like yoke portion has a yoke bottom plate and yoke sidewalls, the yoke bottom plate is disposed between respective yoke sidewalls, wherein the yoke sidewalls are an inner wall of a double wall, and wherein the double wall includes an outer wall, the inner wall, and a folded portion integrally formed from an upper portion of the outer wall and an upper portion of the inner wall.

4. The electroacoustic transducing device according to claim 3, wherein:

rear sound holes which are configured by said openings are disposed.

5. The electroacoustic transducing device according to claim 3, wherein:

external-connection terminal positioning holes which are configured by said openings are disposed.

6. The electroacoustic transducing device according to claim 3, wherein:

insertion ports which are configured by said openings, and which are used for a voice coil support member during an assembling process are disposed.

7. The electroacoustic transducing device according to claim 3, wherein:

cutouts which are configured by said openings, and through which lead wires of said voice coil are drawn out to connecting portions with external connection terminals are disposed.

8. The electroacoustic transducing device according to claim 3, wherein:

a lower hole which is configured by said openings, and which is used for a burring process is disposed, and external connection terminals are coupled to said frame by the burring process and a crushing process of crushing an end portion of a raised portion which is formed by the burring process.

* * * * *